US005845690A

United States Patent [19]

Colson et al.

[11] Patent Number: 5,845,690

[45] **Date of Patent: *Dec. 8, 1998**

[54] FABRIC LIGHT CONTROL WINDOW COVERING WITH RIGID VANES AND SUPPORT CORDS

[75] Inventors: Wendell B. Colson, Boulder; James M. Anthony, Denver; Brad H. Oberg, Westminster, all of Colo.; Donald E. Fraser, Owensboro, Ky.

[73] Assignee: Hunter Douglas Inc., Upper Saddle River, N.J.

[ * ] Notice: The term of this patent shall not extend beyond the expiration date of Pat. No. 5,638,880.

[21] Appl. No.: 800,967

[22] Filed: Feb. 18, 1997

Related U.S. Application Data

[63] Continuation of Ser. No. 149,083, Nov. 9, 1993, Pat. No. 5,638,880.

[51] Int. Cl.[6] ..... E06B 3/94

[52] U.S. Cl. ..... 160/84.01; 160/166.1; 160/89; 160/900; 156/302; 156/308.2

[58] Field of Search ..... 160/84.01–84.11, 160/89, 166.1, 168.1 R, 900; 156/308.2, 302; 428/116, 118, 188

[56] References Cited

U.S. PATENT DOCUMENTS

| | | |
|---|---|---|
| Re. 30,254 | 4/1980 | Rasmussen . |
| 1,764,789 | 6/1930 | Heald . |
| 1,937,342 | 11/1933 | Higbie . |
| 2,029,675 | 2/1936 | Schlamp . |
| 2,110,145 | 3/1938 | Loehr . |
| 2,140,049 | 12/1938 | Grauel . |
| 2,267,869 | 12/1941 | Loehr . |
| 2,571,372 | 10/1951 | Martin . |
| 2,620,850 | 12/1952 | Janowski . |
| 2,620,869 | 12/1952 | Friedman . |
| 2,688,356 | 9/1954 | Conti . |
| 2,822,840 | 2/1958 | Reynolds et al. . |
| 2,856,324 | 10/1958 | Janowski . |
| 2,865,446 | 12/1958 | Cole . |
| 2,914,122 | 11/1959 | Pinto . |
| 2,994,370 | 8/1961 | Pinto . |
| 3,032,099 | 5/1962 | Croxen . |
| 3,170,505 | 2/1965 | Lorentzen et al. ..... 160/178.3 R |
| 3,384,519 | 5/1968 | Froget . |
| 3,661,665 | 5/1972 | Froget . |
| 3,682,752 | 8/1972 | Hunter et al. . |

(List continued on next page.)

FOREIGN PATENT DOCUMENTS

| | | |
|---|---|---|
| 249985 | 5/1961 | Australia . |
| 2090046 | 2/1993 | Canada . |
| 29442 | 6/1980 | European Pat. Off. . |
| 688935 | 12/1995 | European Pat. Off. . |
| 1166398 | 2/1957 | France . |
| 1309194 | 7/1961 | France . |
| 1364674 | 5/1964 | France . |
| 1373515 | 8/1964 | France . |
| 1381472 | 3/1965 | France . |
| 1480262 | 3/1966 | France . |
| 1465261 | 11/1966 | France . |
| 1526507 | 6/1967 | France . |
| 1585159 | 8/1968 | France . |
| 2398170 | 2/1979 | France . |
| 122088 | 4/1900 | Germany . |
| 382758 | 5/1922 | Germany . |
| 684202 | 11/1939 | Germany . |
| 1241361 | 5/1967 | Germany . |
| 1942674 | 8/1969 | Germany . |

(List continued on next page.)

*Primary Examiner*—Blair Johnson
*Attorney, Agent, or Firm*—Dorsey & Whitney LLP

[57] ABSTRACT

Various systems for attaching flexible fabric material to rigid vanes in the construction of window coverings are disclosed. The various systems for attaching the fabric material to the vanes create varying aesthetic patterns while providing long-term durability. The systems described can be used to connect single or double sheets of fabric material to the faces of rigid vanes while enabling the vanes to be oriented vertically or horizontally.

15 Claims, 13 Drawing Sheets

U.S. PATENT DOCUMENTS

| | | | |
|---|---|---|---|
| 3,701,376 | 10/1972 | Froget . | |
| 3,844,330 | 10/1974 | Hyman . | |
| 3,851,699 | 12/1974 | Shapiro . | |
| 3,916,973 | 11/1975 | Schuppler et al. | 160/178.3 R |
| 3,999,590 | 12/1976 | Koch . | |
| 4,009,626 | 3/1977 | Gressman . | |
| 4,019,554 | 4/1977 | Rasmussen . | |
| 4,039,019 | 8/1977 | Hopper . | |
| 4,052,521 | 10/1977 | Ferrari . | |
| 4,137,111 | 1/1979 | Hansen . | |
| 4,194,550 | 3/1980 | Hopper . | |
| 4,236,567 | 12/1980 | Frentzel | 160/178.3 R |
| 4,309,472 | 1/1982 | Gotting et al. . | |
| 4,344,474 | 8/1982 | Berman . | |
| 4,377,431 | 3/1983 | Chodosh . | |
| 4,386,454 | 6/1983 | Hopper . | |
| 4,397,704 | 8/1983 | Frick . | |
| 4,450,027 | 5/1984 | Colson . | |
| 4,475,579 | 10/1984 | Bassett | 160/178.3 R |
| 4,535,828 | 8/1985 | Brockhaus . | |
| 4,685,986 | 8/1987 | Anderson . | |
| 4,732,630 | 3/1988 | Schnebly . | |
| 4,815,581 | 3/1989 | Deutschlander . | |
| 4,826,555 | 5/1989 | Long . | |
| 4,884,612 | 12/1989 | Schnebly et al. . | |
| 4,885,190 | 12/1989 | Schnebly . | |
| 4,895,611 | 1/1990 | Brynlarski et al. . | |
| 4,909,870 | 3/1990 | Gould et al. . | |
| 4,928,369 | 5/1990 | Schnebly et al. . | |
| 4,948,445 | 8/1990 | Hees . | |
| 5,012,552 | 5/1991 | Wulf . | |
| 5,106,444 | 4/1992 | Corey et al. . | |
| 5,228,936 | 7/1993 | Goodhue . | |
| 5,287,908 | 2/1994 | Hoffmann et al. . | |
| 5,301,733 | 4/1994 | Toti . | |
| 5,313,999 | 5/1994 | Colson et al. . | |
| 5,339,883 | 8/1994 | Colson et al. . | |
| 5,490,553 | 2/1996 | Colson et al. . | |
| 5,638,880 | 6/1997 | Colson et al. . | |

FOREIGN PATENT DOCUMENTS

| | | |
|---|---|---|
| 7008554 | 12/1970 | Germany . |
| 2735654 | 8/1977 | Germany . |
| 2923233 | 12/1980 | Germany . |
| 2936811 | 4/1981 | Germany . |
| 3525515 | 1/1987 | Germany . |
| 8906284 | 9/1989 | Germany . |
| 7805464 | 10/1979 | Netherlands . |
| 331432 | 7/1958 | Switzerland . |
| 423207 | 4/1967 | Switzerland . |
| 476482 | 9/1969 | Switzerland . |
| 494338 | 9/1970 | Switzerland . |
| 951484 | 3/1964 | United Kingdom . |
| 1036126 | 7/1966 | United Kingdom . |
| 1116934 | 6/1968 | United Kingdom . |
| 1228677 | 4/1971 | United Kingdom . |
| 8002712 | 12/1980 | WIPO . |

FABRIC LIGHT CONTROL WINDOW COVERING WITH RIGID VANES AND SUPPORT CORDS

CROSS REFERENCE TO RELATED APPLICATION

The present application is a continuation of application Ser. No. 08/149,083 filed Nov. 9, 1993, now U.S. Pat. No. 5,638,880, for Fabric Light Control Window Covering With Rigid Vanes.

BACKGROUND OF THE INVENTION

1. Field of the Invention

The present invention relates generally to window coverings and more particularly to fabric-type window coverings provided with adjustable vanes for controlling the amount of light passing therethrough.

2. Description of the Prior Art

Fabric window coverings are often preferred by consumers for a number of their features. The features most often considered desirable are the softer appearance relative to traditional venetian blinds, the uniform appearance which they provide a window, and insulating properties associated with cellular fabric shades.

Cellular fabric shades offering these features are known in the art. For example, U.S. Pat. No. 4,450,027 to Colson discloses cellular window coverings which may be made of fabric or film materials. In the process disclosed in the Colson patent, a flexible strip of material is folded into a continuous longitudinal tube and the longitudinal folds thus created are permanently set by passing the tubing material around a heat setting wheel. Adhesive is applied along one side of the flattened tubular material which is subsequently stacked by winding onto a rack having flat surfaces. The winding in this manner presses the adhesive to the next layer wound onto the rack to form a bonded unitary stack of closed tubular cells. When the ends are cut from the rack, the stack may be expanded and the permanently set creases provide a neat and uniform outward appearance.

U.S. Pat. No. 4,732,630 to Schnebly discloses a modification to the Colson process described above. In the Schnebly patent, a hot melted adhesive is applied to one side of the tubular material. After the flat tubular strips have been stacked and cut, they are placed in an oven under pressure and the hot melted adhesive is activated to bond the layers together.

Both of the above patents disclose window coverings which exhibit the desirable features discussed to this point. However, window coverings of that type lack one feature which is often desired by consumers. That feature is the ability to control the amount of light admitted through the window covering, similar to a traditional venetian blind. There have been some attempts to provide a fabric window covering with the ability to control the amount of light entering the room. However, these attempts have lacked one or more of the features discussed above and have been less than successful.

U.S. Pat. No. 3,384,519 to Froget discloses one such attempt. The window covering disclosed therein consists of two cloth layers spaced apart by moveable parallel and flexible fabric blades having each of their marginal edges heat welded to one of the moveable cloth layers. With this window covering, relative movement of the two cloth layers in a direction perpendicular to the blades changes the angle of the blades and thus controls the amount of light admitted through the article. A number of undesirable features of the Froget window covering derive from the fact that it is constructed utilizing a heat welding process. First, this limits the fabrics which may be utilized to thermoplastic materials. Also, heat welding necessarily requires a melting of at least some of the fibers of the materials bonded, thus providing an uneven outer appearance along the heat welds and producing unwanted crimps or creases in the materials which can result in failure of the fabric fibers. Further, heat welding is a relatively slow process which may require six or more seconds to create a bond over an extended length. This is too slow for application in high volume commercial production processes. Other draw backs of the Froget window covering are that heat welds are limited in strength and it is difficult to achieve uniformly straight heat-welded joints over an extended length.

U.S. Pat. No. 2,865,446 to Cole discloses a window covering in which a long rectangular piece of fabric is doubled back upon itself and a plurality of pleated elements are placed between the folded-over sheets. The pleated elements are an accordion-pleated fabric which extends when the two sides of the folded over fabric are moved relative to one another in a direction perpendicular to the accordion pleats. Such a window covering does not provide a uniform appearance because the accordion-pleated fabric located close to the top of the window covering does not expand to the same extent as the fabric closer to the bottom of the window covering. Also, it is very difficult to insure that such accordion-pleated fabric returns to its desired position after each expansion.

The construction of Cole inherently creates an undesirable feature if a woven-type sheer fabric is used for the folded over, long rectangular piece of fabric. That undesirable feature is a moire effect or interference pattern which would result when light is viewed through the folded over fabric. The Froget window covering would also appear to have this drawback because the embodiment shown in FIG. 8 of that patent appears to show front and back fabrics of the same material.

French Patent No. 1,309,194 discloses a curtain with variable opacity. In this curtain, screen or mesh parallel sides are provided with tiltable braids therebetween. The braids are said to be attached at their edges to the sides. However, no means for attachment is specified. The drawings appear to indicate a hinged-type attachment and the specification ends by stating that the difficulties of construction are substantial.

U.S. Pat. No. 3,851,699 issued to Shapiro discloses a vertical louver-type window drape wherein a continuous sheet of fabric material is interwoven with a plurality of relatively rigid vanes such that the vanes which are light impeding alternate with light transmitting sections of the fabric. One obvious drawback with a system of this type is that the vanes overlap the fabric requiring excessive fabric in order to fabricate the entire window covering. Further, the vanes or louvers are only attached to the fabric material along a top and bottom edge thereof, thereby inhibiting the control over the fabric material during operation of the window covering.

Another window covering showing the combination of relatively rigid vanes with a sheet of fabric is disclosed in U.S. Pat. No. 3,844,330 issued to Hyman. In the Hyman patent, vertically extending louvers have drape material hung thereover in a way such that a normal drape-like affect is obtained regardless of the angular orientation of the louvers. As with the system employed in the Shapiro patent, the sheet of fabric material in one arrangement is interwoven with the louvers thereby requiring excessive fabric, whereas in another embodiment the fabric is merely attached to a side edge of the louver to create a different visual affect. While the patent acknowledges that the fabric material may be attached to the louvers along the full length of the louvers, it is expressed that a desirable arrangement is to merely attach the fabric to the louvers along an upper edge to provide a full drapery-like affect.

It is to improve upon the shortcomings in the prior art fabric window coverings that the present invention has been made.

SUMMARY OF THE INVENTION

The present invention principally concerns a fabric-type window covering wherein substantially rigid vanes are uniquely attached to softer sheets or strips of fabric material. The attachment systems do not detract from the aesthetics of the window covering and extend the life of the window covering by addressing issues of fabric fatigue which cause failures in window coverings of the same general type upon repeated movement of the window coverings between open and closed positions.

The invention is disclosed in various embodiments with some of the embodiments incorporating only a single sheet of fabric material affixed along one face to common side edges of a plurality of rigid vanes. In other embodiments similar attachment systems of the vanes to a second sheet of similar fabric material are employed so that the vanes extend between substantially parallel sheets of fabric material.

Typically, when a single sheet of fabric material is affixed to the vanes, the vanes are suspended vertically in a manner such that the vanes themselves are pivotable about longitudinal vertical axes to move the window covering between open and closed positions. However, when dual sheets of fabric are affixed to opposite edges of the vanes, the vanes can be suspended vertically or horizontally. When suspended vertically, pivotal movement of the vanes about the longitudinal vertical axes again moves the window covering between open and closed positions, but when the vanes extend horizontally, typically the fabric sheets themselves are shifted in opposite vertical directions to move the vanes between an open position wherein they lie perpendicular to the sheets of fabric and a closed position wherein they extend substantially parallel to the sheets of fabric.

The vanes can also be oriented horizontally while attached to a single sheet of fabric by utilizing vertical cords affixed to the opposite edge of the vanes from the fabric sheet to uniformly support the opposite edges of the vanes.

The various methods employed for affixing the sheet or sheets of fabric material to the vanes provide varied appearances to the window covering as will be more clear with the detailed description of the invention that follows. As will also become clear with the detailed description that follows, the fabric sheets can either be a single sheet of material or can be fabricated from a plurality of strips of such material which are uniquely joined into one larger sheet which is integrated with the rigid vanes.

Other aspects, features and details of the present invention can be more completely understood by reference to the following detailed description of the preferred embodiments, taken in conjunction with the drawings and from the appended claims.

DESCRIPTION OF THE PREFERRED EMBODIMENTS

Figure 1:
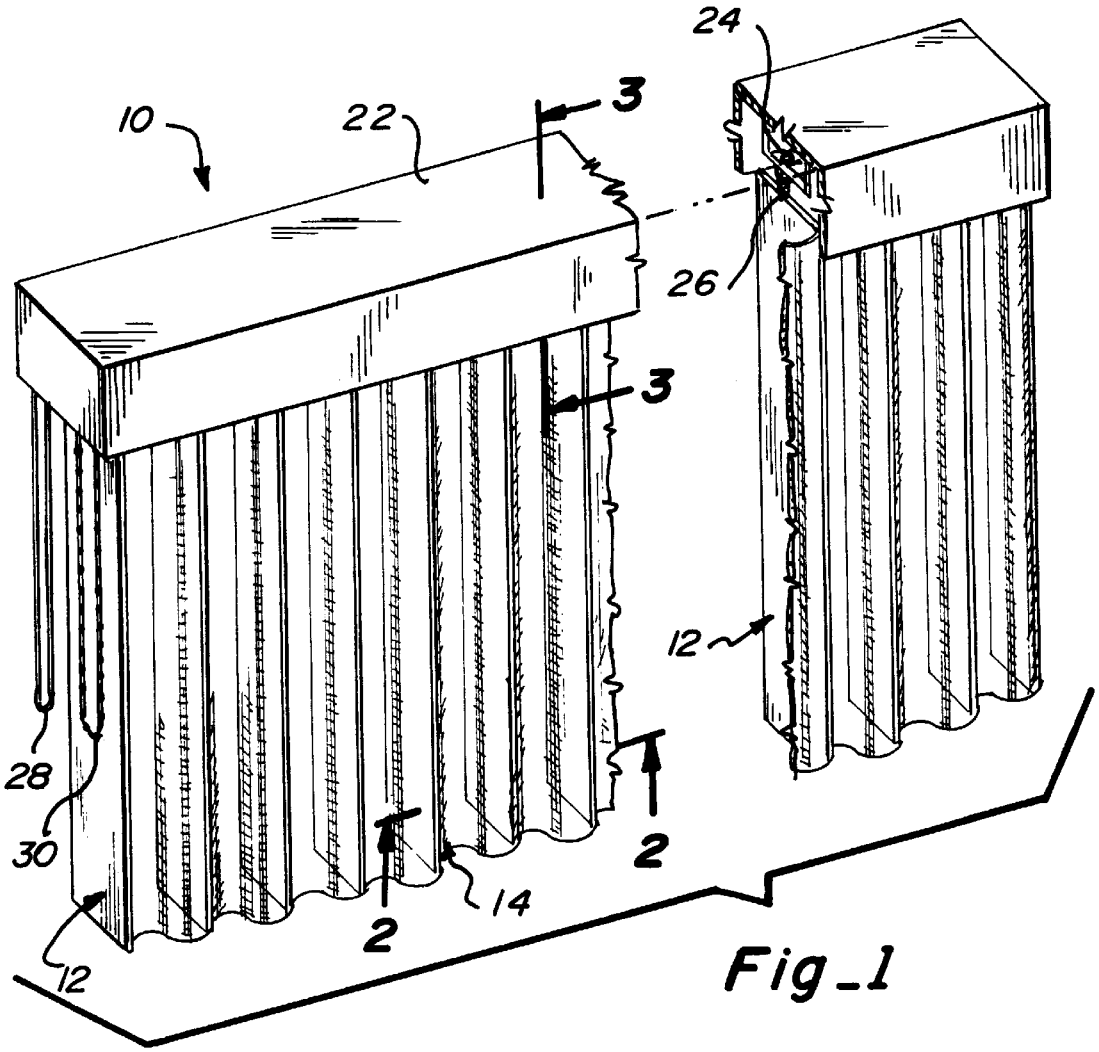
FIG. 1 is an isometric view with parts broken away for clarity of a window covering fabricated in accordance with the present invention.
Figure 2:
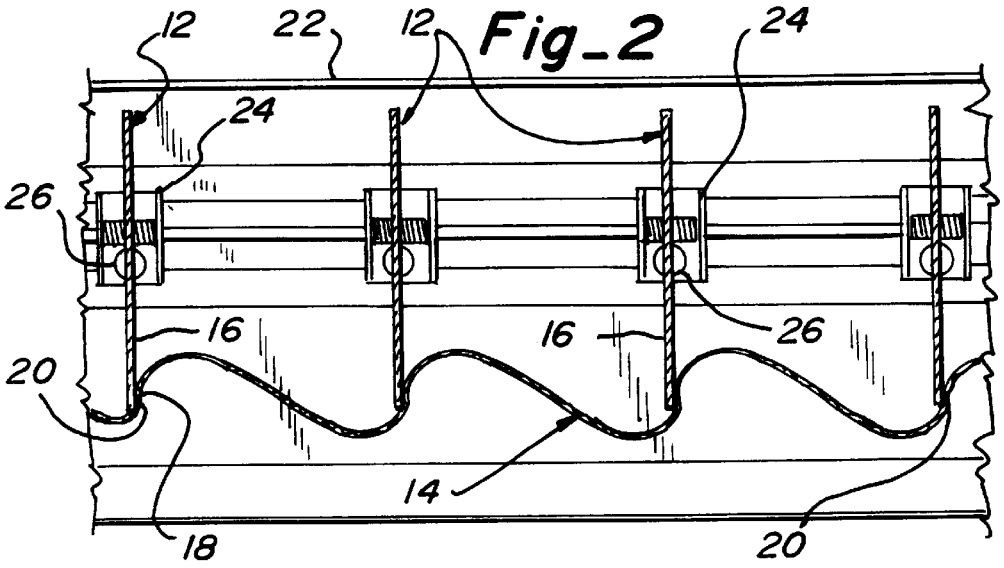
FIG. 2 is a horizontal section taken along line 2—2 of FIG. 1.
Figure 3:
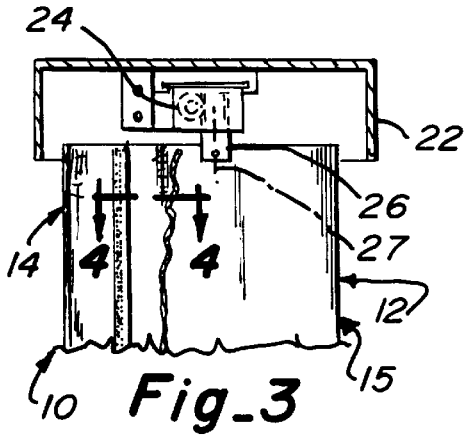
FIG. 3 is a vertical section taken along line 3—3 of FIG. 1.

A window covering 10 fabricated generally in accordance with the teachings of the present invention is illustrated in FIG. 1 to include a plurality of vertically suspended rigid vanes 12 having a sheet 14 of fabric material affixed to planar faces 16 of the vanes along a marginal area 18 adjacent to a front side edge 20 of the vanes. The vanes can be made of any rigid or substantially rigid material that is light enough to be suited for use in a window covering and which does not break down under temperatures known to be prevalent in windows exposed to excessive sunlight. Suitable materials would include aluminum and plastic.

The vanes 12 are suspended in an upper housing 22 and are mounted on carriers 24 which are adapted to pivot the vanes in known manners about shafts 26 having longitudinal vertically extending axes 27 by movement of a first pull chain 28 and can also be reciprocally moved laterally along a linear path by a second pull chain or cord 30 so that the vanes can be selectively moved into closely adjacent relationship adjacent one side of the window opening (not shown) in which the window covering is mounted. The longitudinal vertical axes 27 of the vanes are offset toward the fabric sheet 14 from the central vertical axes of the vanes so that the vanes and the fabric sheet will hang vertically. As will be appreciated, when the vanes are pivoted about the shafts 26 and their longitudinal pivotal axes, they can be moved between an open position as illustrated in FIG. 1 wherein the vanes 12 are substantially perpendicular to the fabric sheet 14 and one of two closed positions by rotating the vanes in opposite directions until they extend substantially coplanar with each other and parallel to the fabric sheet to which they are attached.

As will be appreciated with the description of the invention that follows, movement of the vanes between their opposite or reverse closed positions creates a different aesthetic appearance for the window covering. Of course, movement of the vertical vanes laterally in a linear horizontal direction so that they are moved into closely adjacent relationship with each other adjacent to the side of the window opening causes the entire fabric sheet to which they are attached to move into a collapsed position adjacent to one side of the window opening. As will also be appreciated with the description that follows, the fabric sheet 14 used on the window covering will somewhat simulate typical curtains in that it can be suspended in a curvilinear or wave-like configuration as with conventional fabric curtains.

The present invention includes several different systems for affixing a fabric sheet or sheets to the rigid vanes with like parts in each system having been assigned like reference numerals. The first embodiment 15 of such a system is illustrated in FIGS. 1–16. It will therein be appreciated that there is a single continuous sheet 14 of fabric material having an inner face 32 directed toward the vanes 12 and an outer face 34 directed away from the vanes. The sheet may be conventional sheer fabric. The sheet is sized so as to be closely related in height to the height of the window in which the window covering is mounted but is preferably substantially greater in width than the window so that a plurality of curves or ripples are formed in the sheet when viewed in horizontal cross-section whereby the fabric sheet simulates a typical curtain-type window covering.

Figure 4:
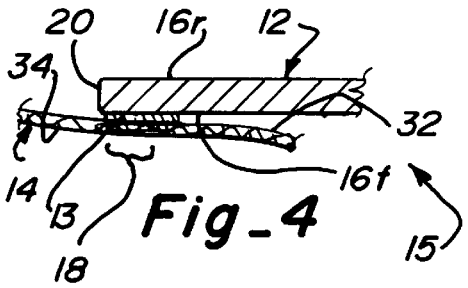
FIG. 4 is an enlarged section taken along line 4—4 of FIG. 3.
Figure 5:
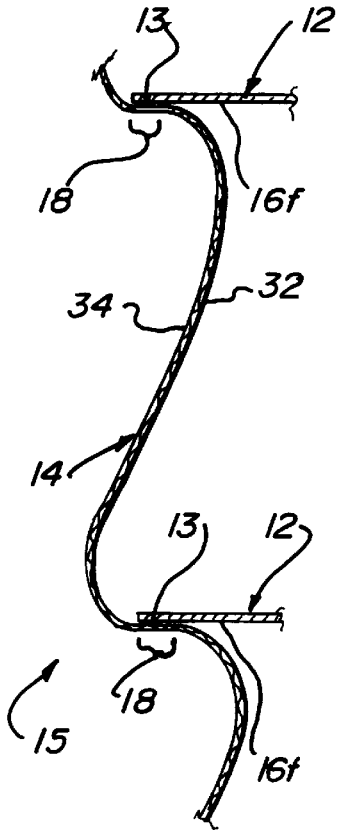
FIG. 5 is an enlarged fragmentary section illustrating a first embodiment of the present invention with the vanes in an open position.

As probably best illustrated in FIGS. 4 and 5, the inner face 32 of the fabric sheet 14 is continuously affixed to each individual vane 12 along a marginal area 18 of a front planar face 16*f* of the vane. For purposes of the present disclosure, reference to a marginal area 18 of a component of the window covering such as a vane, fabric strip or ribbon-like connector should be construed to mean an area on a substantially planar face of the component which is adjacent to a side edge of the component. The marginal area would extend parallel to the associated side edge of the component and would be of a width adequate to accommodate affixation of a sheet or strip of fabric to the component. The fabric 14 is affixed to the vanes 12 with a conventional adhesive 13 such as hot-melt adhesive which can be applied to the marginal area 18 of the front face 16*f* of each vane prior to bonding the sheet 14 to the vane in a conventional manner. It will therefore be appreciated that continuous vertical lines of attachment exist for the connection of each vane to the fabric sheet along the associated marginal area. An adhesive found to be suitable for purposes of the present invention is a hot-melt polyester copolymer glue manufactured by EMS-American Grilon, Inc. of Charlotte, N.C., under the brand name Grilltex.

Figure 6:
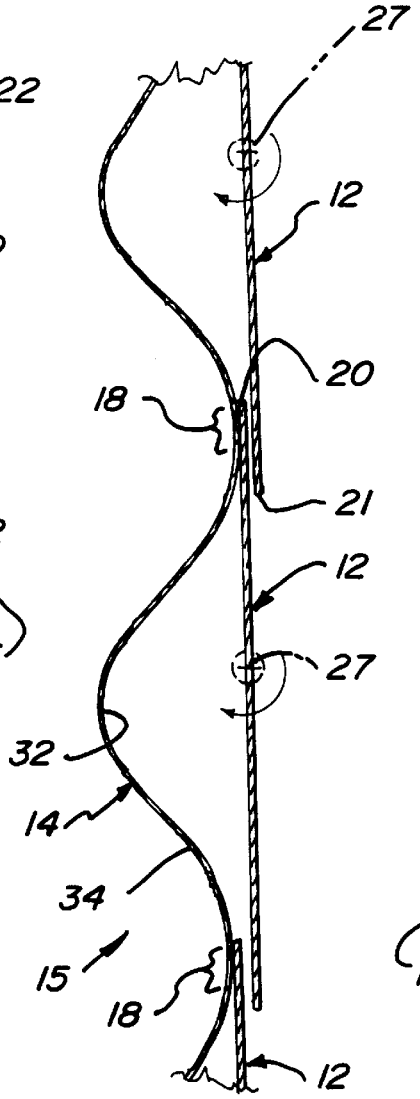
FIG. 6 is a fragmentary horizontal section similar to FIG. 5 with the vanes in a first closed position.
Figure 7:
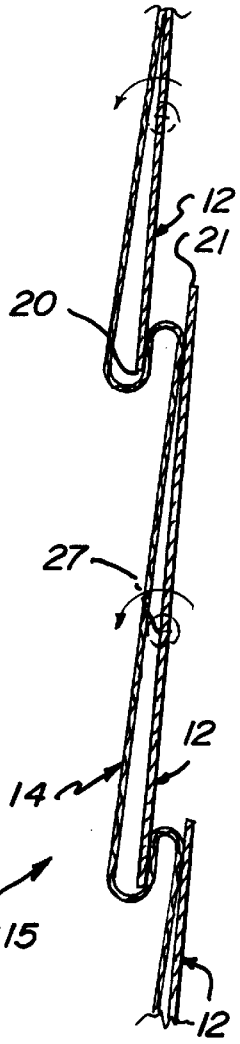
FIG. 7 is a fragmentary section similar to FIG. 6 with the vanes in a second oppositely rotated closed position.

When the vanes 12 are in an open position as illustrated in FIG. 5, the fabric sheet 14 forms an S-shaped curve associated with each vane when viewed in horizontal cross-section, but when the vanes are moved into a first closed position as illustrated in FIG. 6, the fabric sheet defines arcuate curves overlying adjacent vanes so as to appear similarly to curtain-type window coverings. By pivoting the vanes approximately 180 degrees from the position of FIG. 6, the vanes assume a second closed position as shown in FIG. 7 wherein it will be appreciated that the fabric sheet 14 assumes a configuration similar to that which it assumes when the vanes are open as shown in FIG. 5, but wherein the generally S-shaped curvatures of the fabric sheet are closely adjacent to the face 16 of each vane.

Figure 8:
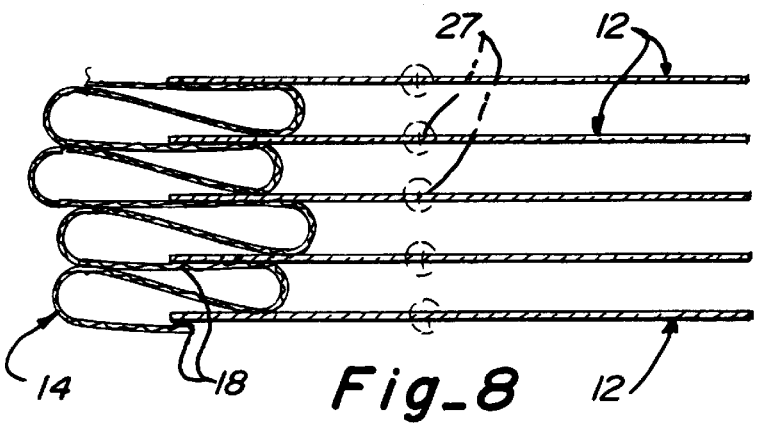
FIG. 8 is a horizontal section showing the window covering in an open position but with the vanes having been shifted to closely adjacent relationship.
Figure 9:
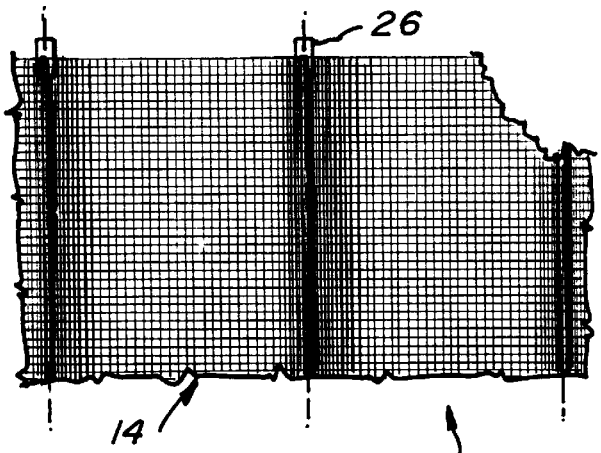
FIG. 9 is a front elevation showing the window covering as illustrated in FIG. 5.
Figure 10:
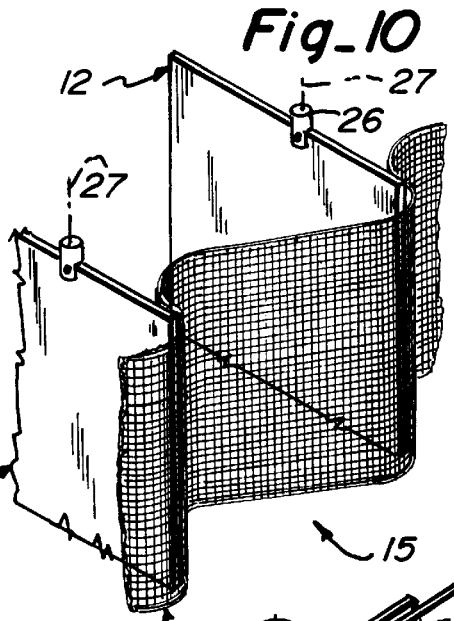
FIG. 10 is an isometric view of the window covering as shown in FIG. 9.
Figure 11:
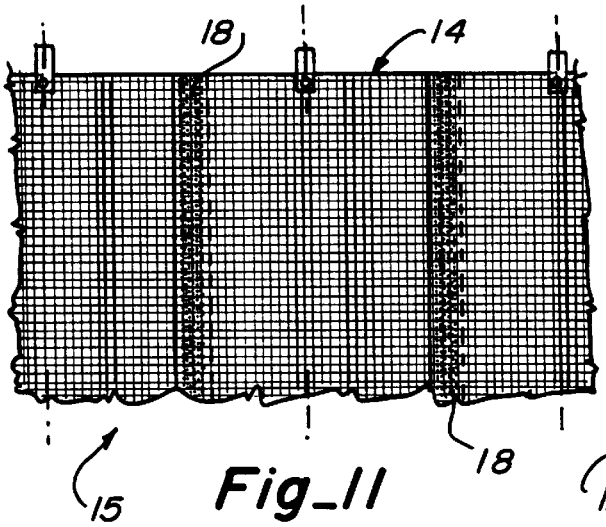
FIG. 11 is a front elevation of the window covering as illustrated in FIG. 6.
Figure 12:
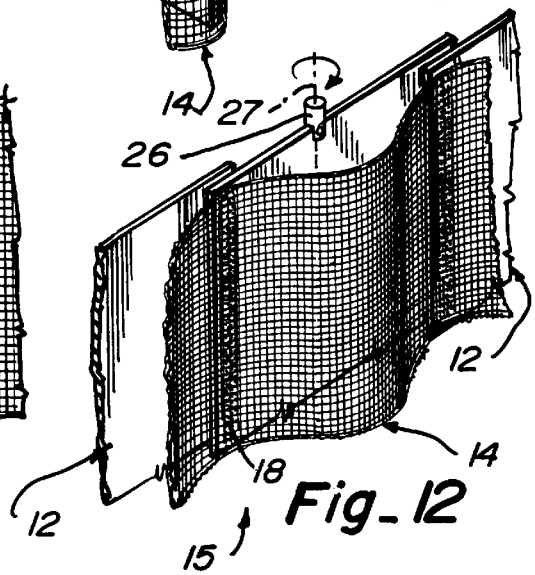
FIG. 12 is a fragmentary isometric view of the window covering as seen in FIG. 11.
Figure 13:
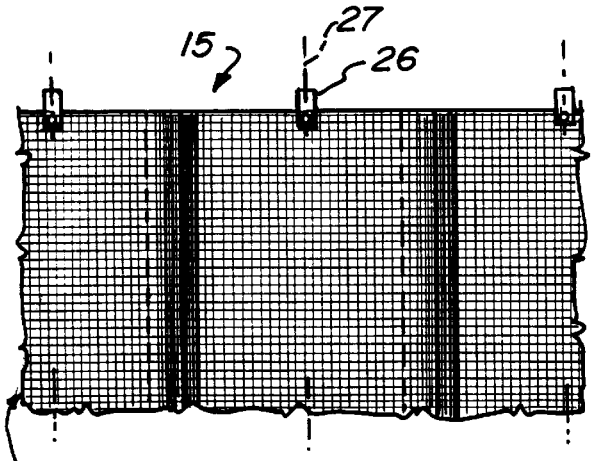
FIG. 13 is a fragmentary front elevation of the window covering as seen in FIG. 7.
Figure 14:
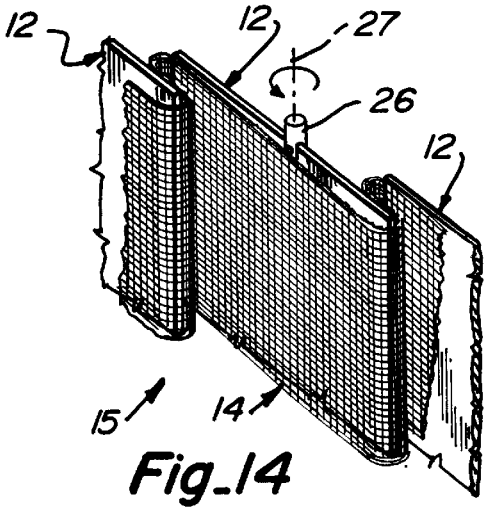
FIG. 14 is a fragmentary isometric view of the window covering as seen in FIG. 13.
Figure 15:
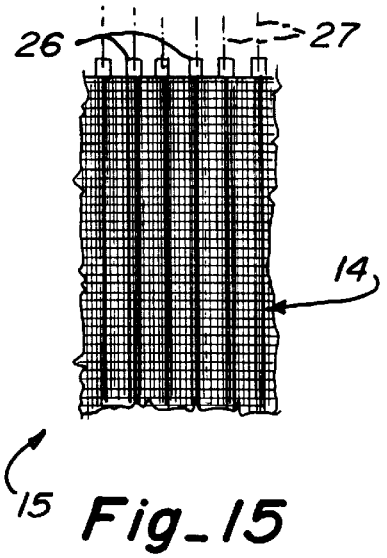
FIG. 15 is a fragmentary front elevation of the window covering as shown in FIG. 8.
Figure 16:
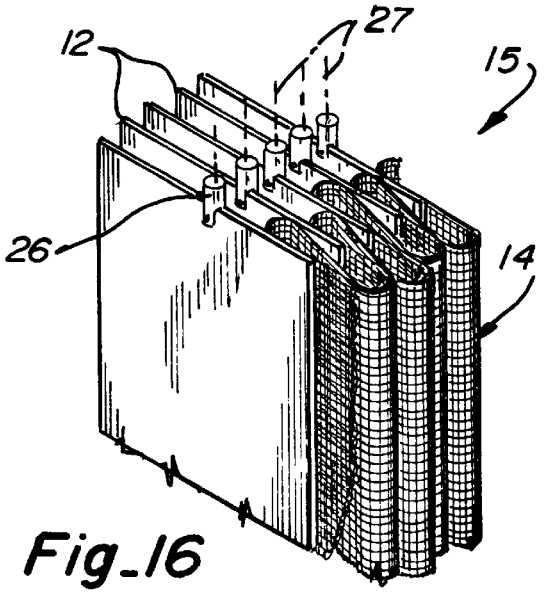
FIG. 16 is a fragmentary isometric view of the window covering as illustrated in FIG. 15.

As seen in FIG. 8, when the fabric sheet 14 is connected to the vanes 12 in accordance with the first embodiment 15 of the invention and the vanes have been shifted into a position where they are open but in closely adjacent relationship with each other, the fabric sheet again assumes a plurality of tight or contiguous S-shaped curves associated with each vane, with approximately one-half of each S-shaped curve confined between a pair of adjacent vanes.

A better view of the window covering when fabricated in accordance with the first embodiment of the present invention is shown in the isometric views of FIGS. 9–16 wherein it will be seen that various appealing aesthetic configurations are created by movement of the vanes between the open and first and second closed positions.

Figure 17:
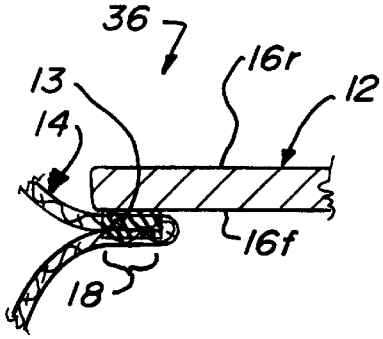
FIG. 17 is an enlarged horizontal section showing a second embodiment for affixing the fabric sheet to a rigid vane.
Figure 18:
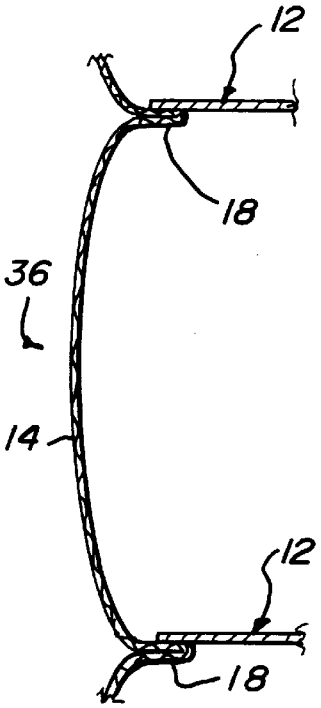
FIG. 18 is a fragmentary horizontal section showing a fabric sheet affixed to a pair of vanes in accordance with the system disclosed in FIG. 17 with the vanes in an open position.

FIG. 17 shows a second embodiment 36 of the window covering of the present invention which utilizes a different system for affixing a continuous sheet 14 of fabric material to a plurality of vanes 12. As shown in FIG. 17, the fabric sheet is a continuous sheet of a size similar to that described in accordance with the first-described embodiment. The sheet is also continuously affixed to the front planar face 16*f* of each vane along a marginal area 18 of the vane, but the sheet 14 is then folded back upon itself and continuously bonded to itself along the same line where the sheet is bonded to the vane. The fabric sheet thus dips into the space between adjacent vanes 12 when the vanes are open and then is immediately reversed and brought outwardly away from the vanes as best illustrated in FIG. 18.

Figure 19:
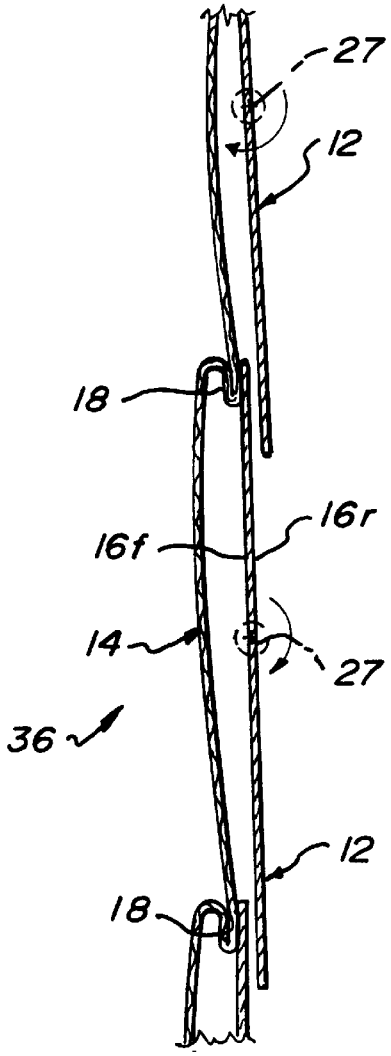
FIG. 19 is a fragmentary horizontal section similar to FIG. 18 with the vanes in a first closed position.
Figure 20:
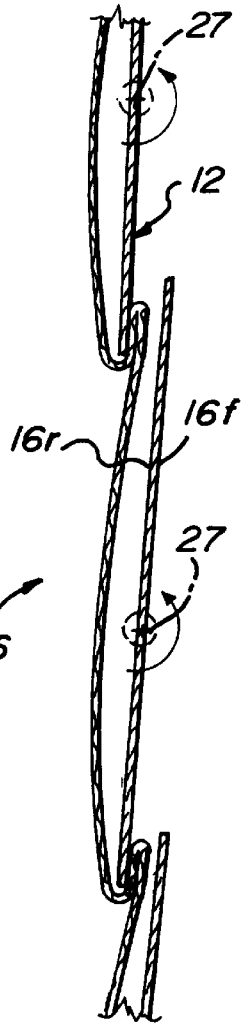
FIG. 20 is a fragmentary horizontal section similar to FIG. 19 with the vanes in a reversed second closed position.

As will be appreciated, the fabric sheet 14 assumes a configuration defining arcuate segments between adjacent vanes 12 when the vanes are open but when the vanes are moved into the first closed position illustrated in FIG. 19, the fabric sheet assumes a position closely adjacent to the front faces 16*f* of the vanes. A similar positioning of the fabric occurs when the vanes are pivoted through 180 degrees into the second closed position of FIG. 20 wherein the fabric sheet assumes a position in very closely spaced relationship to rear faces 16*r* of the vanes.

Figure 22:
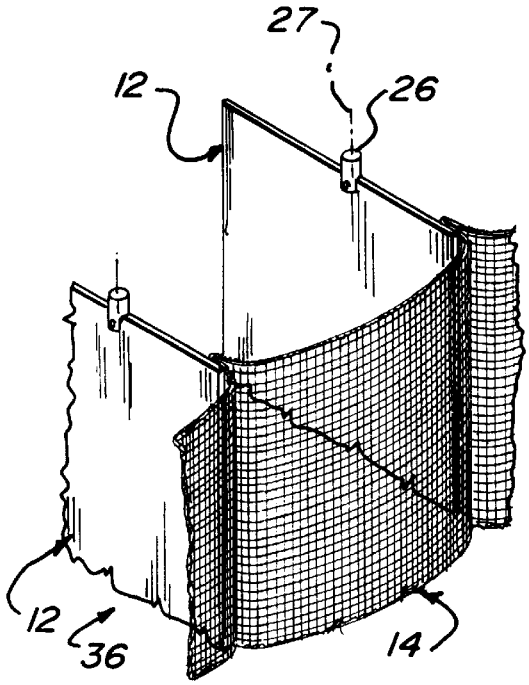
FIG. 22 is a fragmentary isometric view showing the second embodiment of the present invention as seen in FIG. 18.
Figure 23:
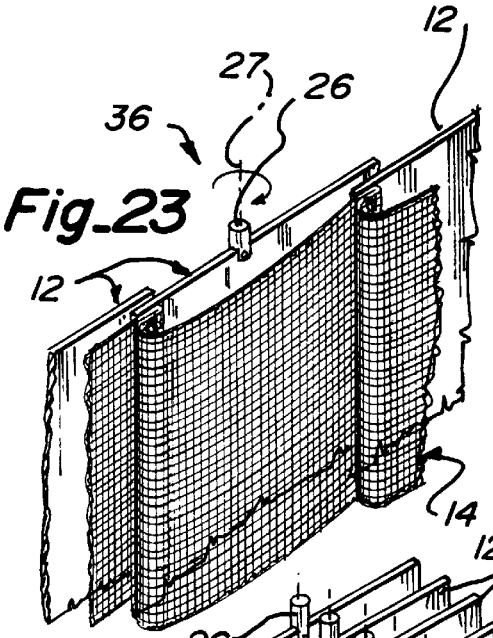
FIG. 23 is an isometric view similar to FIG. 22 with the vanes in a first closed position.
Figure 24:
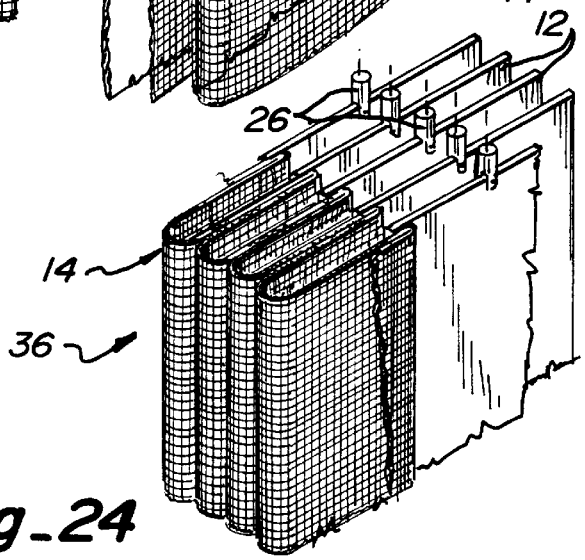
FIG. 24 is a fragmentary isometric view of the second embodiment of the invention as shown in FIG. 21.
Figure 21:
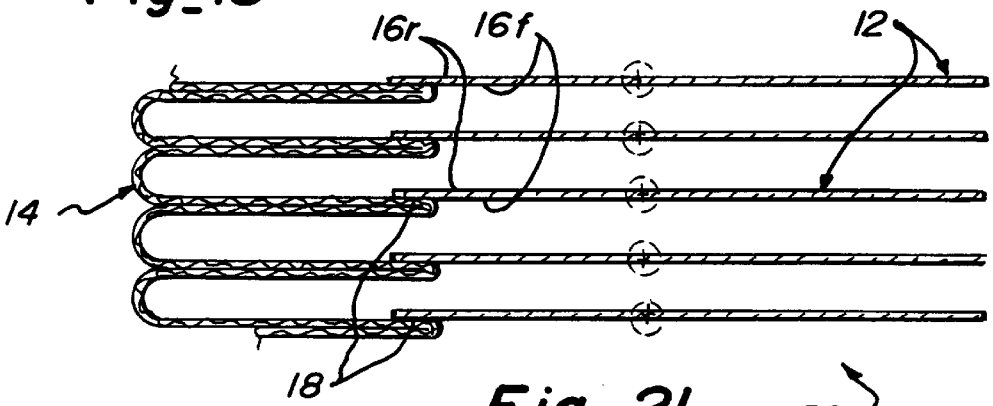
FIG. 21 is a fragmentary horizontal section showing the vanes in a position similar to FIG. 18 but with a plurality of the vanes having been moved into closely adjacent relationship.
Figure 25:
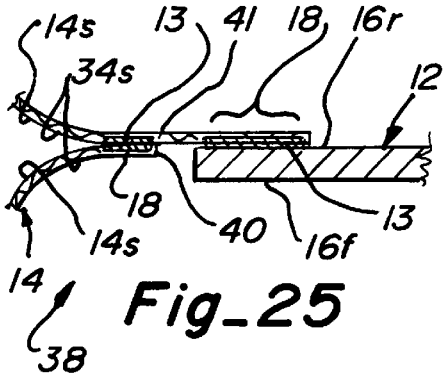
FIG. 25 is an enlarged horizontal section showing a third embodiment or system for affixing the fabric sheet to the rigid vanes.
Figure 26:
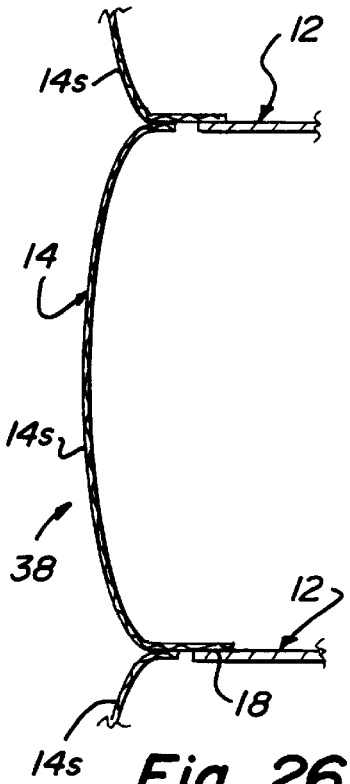
FIG. 26 is a horizontal section showing strips of fabric sheet being affixed to open vanes in accordance with the system disclosed in FIG. 25.
Figure 27:
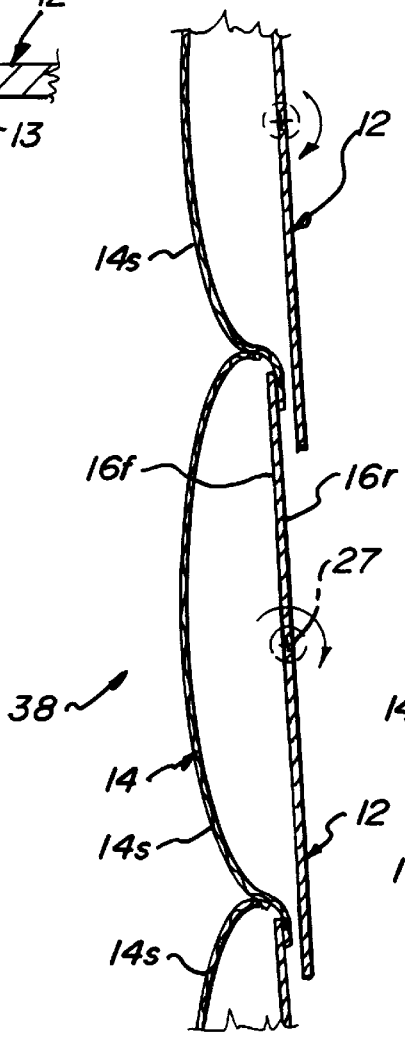
FIG. 27 is a fragmentary horizontal section similar to FIG. 26 with the vanes in a first closed position.
Figure 28:
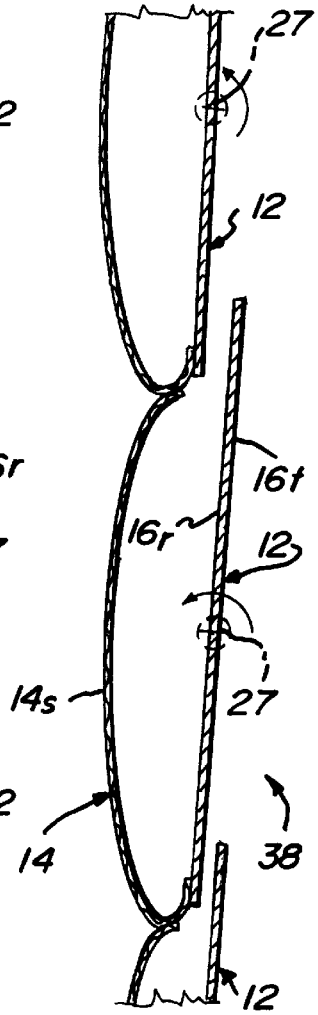
FIG. 28 is a fragmentary horizontal section similar to FIG. 27 with the vanes in a reverse second closed position.

In referencing FIG. 21, it will be appreciated that when the vanes are positioned in their open position and moved into closely adjacent relationship to each other, the fabric sheet projects outwardly in directions substantially parallel with the vanes so as to form a plurality of adjacent side by side U-shaped loops, each loop being associated with a vane. FIGS. 22–24 are isometric views more directly illustrating the aesthetics of the second embodiment of the present invention.

In a third embodiment 38 of the window covering of the present invention, shown in FIGS. 25–35, the fabric sheet 14 is fabricated from a plurality of elongated vertically extending strips 14*s* of material which are slightly wider than the vanes 12 with which they are associated so as to provide a curving aesthetic appearance to the covering when mounted on the vanes as will be appreciated with the following description. Each vertical strip 14*s* of fabric has an outer face 34*s* thereof continuously affixed to the rear face 16*r* of an associated vane 12 along a marginal area 18 of the vane as viewed in FIG. 27. The strip extends across the front face 16*f* of the next adjacent vane and has its outer face 34*s* continuously bonded to the outer face 34*s* of the next adjacent strip of fabric near that strip of fabric's connection to the rear face 16*r* of the next adjacent vane. This relationship is clearly illustrated in FIGS. 25–28.

It will therefore be appreciated that in the third embodiment, a marginal area 18 along the outer face 34*s* of each strip of fabric adjacent to one side edge 40 of the strip 14*s* is bonded to a marginal area 18 on the rear face 16*r* of an associated vane 12 and has a marginal area along the opposite side edge 41 on its outer face 34*s* bonded to the outer face 34*s* of the next adjacent strip 14*s* closely adjacent to that strip's connection to the next adjacent vane. With this arrangement, regardless of the position of the vanes, whether in the open position of FIG. 26, the first closed position of FIG. 27, or the reverse second closed position of FIG. 28, the fabric sheet 14 always has the appearance of vertically extending adjacent bowed or curved sections of fabric.

Figure 29:
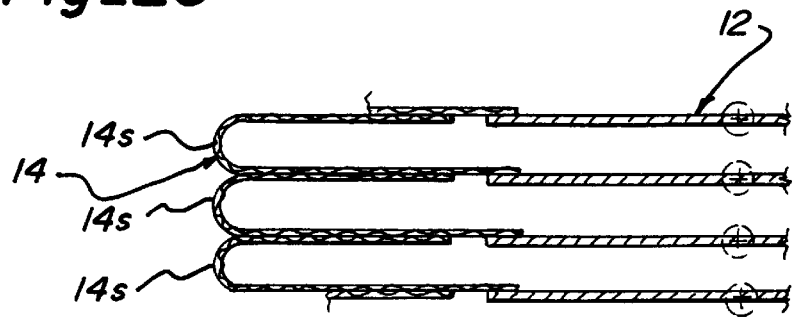
FIG. 29 is a fragmentary horizontal section similar to FIG. 26 with a plurality of vanes having been moved into closely adjacent relationship.
Figure 30:
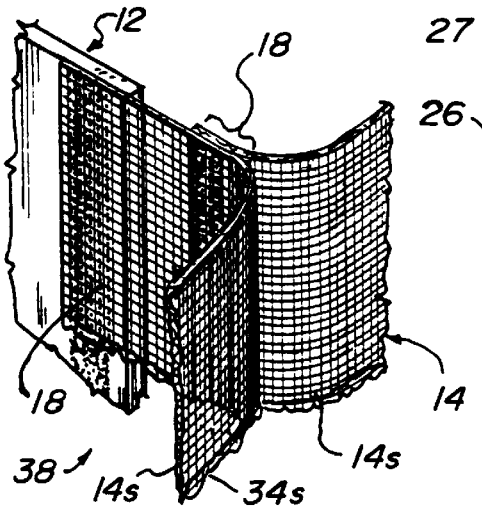
FIG. 30 is an enlarged fragmentary isometric view of the third embodiment as illustrated in FIG. 25.
Figure 33:
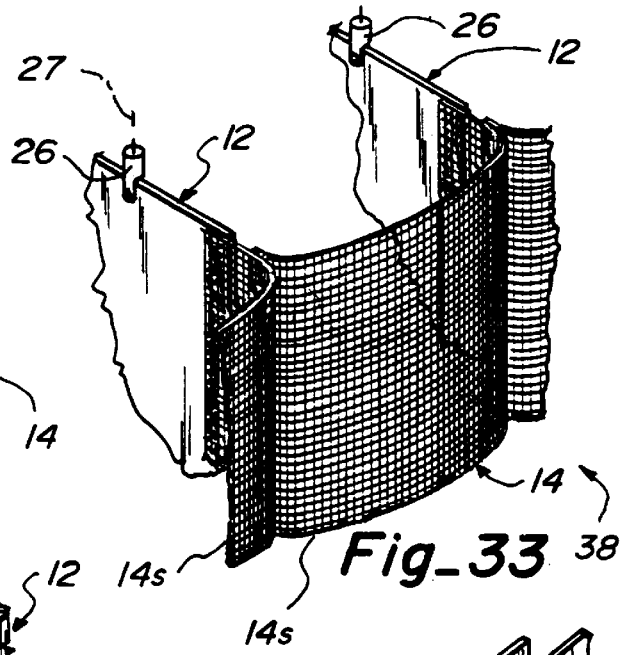
FIG. 33 is a fragmentary isometric view of the third embodiment as shown in FIG. 26.
Figure 31:
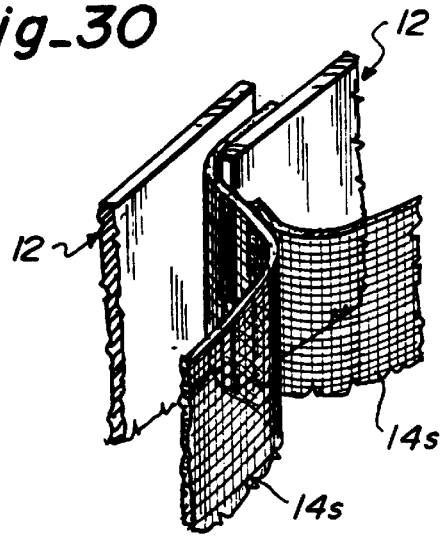
FIG. 31 is an enlarged partial fragmentary isometric view of the third embodiment as shown in FIG. 27.
Figure 34:
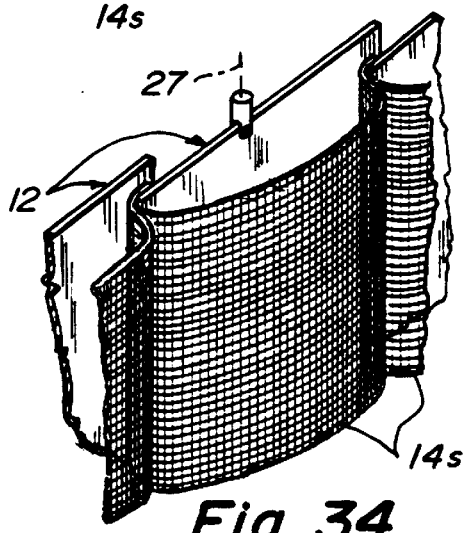
FIG. 34 is a fragmentary isometric view of the third embodiment as illustrated in FIG. 27.
Figure 32:
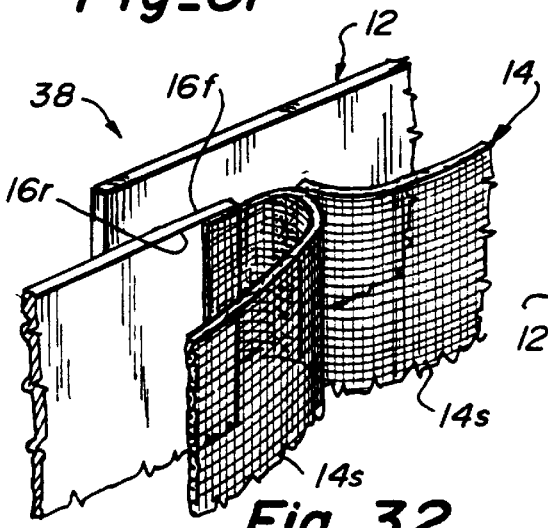
FIG. 32 is an enlarged partial fragmentary isometric view of the third embodiment as illustrated in FIG. 28.
Figure 35:
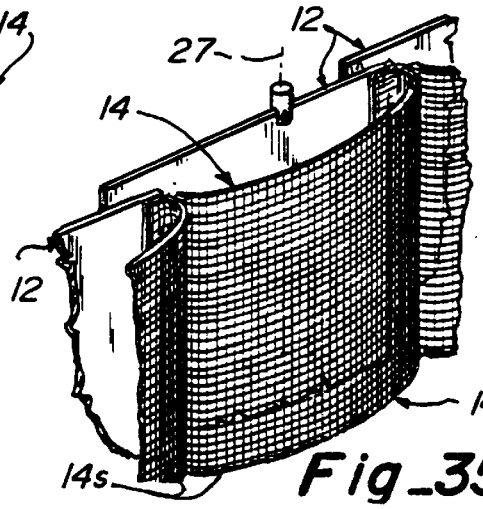
FIG. 35 is a fragmentary isometric view of the third embodiment as shown in FIG. 28.
Figure 36:
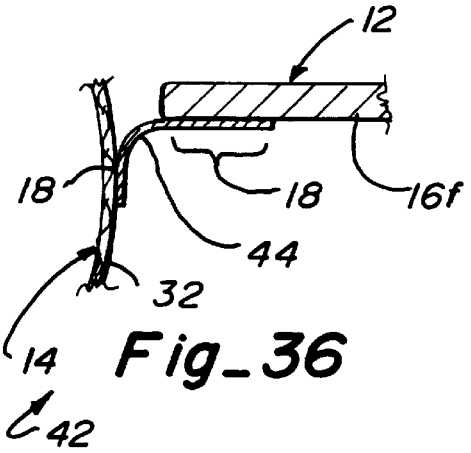
FIG. 36 is an enlarged fragmentary horizontal section showing a fourth embodiment of the invention for connecting the fabric sheet to a rigid vane.

When the vanes 12 are moved in their open position into closely adjacent spaced relationship as shown in FIG. 29, the window covering looks from the exterior very similarly to its appearance in the second embodiment 36 as can be seen in FIG. 21 of the second embodiment. FIGS. 30–35 are isometric views showing the third embodiment 38 of the present invention in a manner which more clearly illustrates the aesthetics that are created with this system of connecting the fabric sheet material to the vanes.

A fourth embodiment 42 of the window covering of the present invention is seen in FIGS. 36–43 to utilize another system for affixing a continuous fabric sheet 14 to a plurality of vanes 12 in a manner such that the fabric sheet can repeatedly bow outwardly in a smooth curving manner at contiguous intervals across the face of the window covering. In the fourth embodiment 42, a separate connector 44 in the form of an elongated vertically extending ribbon, which may be fabric, plastic or any other material having desired flexibility and durability characteristics, continuously interconnects a marginal area 18 on the front face 16*f* of each vane 12 with the inner face 32 of the fabric sheet 14. Each ribbon-like connector 44 is continuously bonded along its same face to the marginal area 18 on the front face 16*f* of a vane 12 and to the inner face 32 of the fabric sheet.

Figure 51:
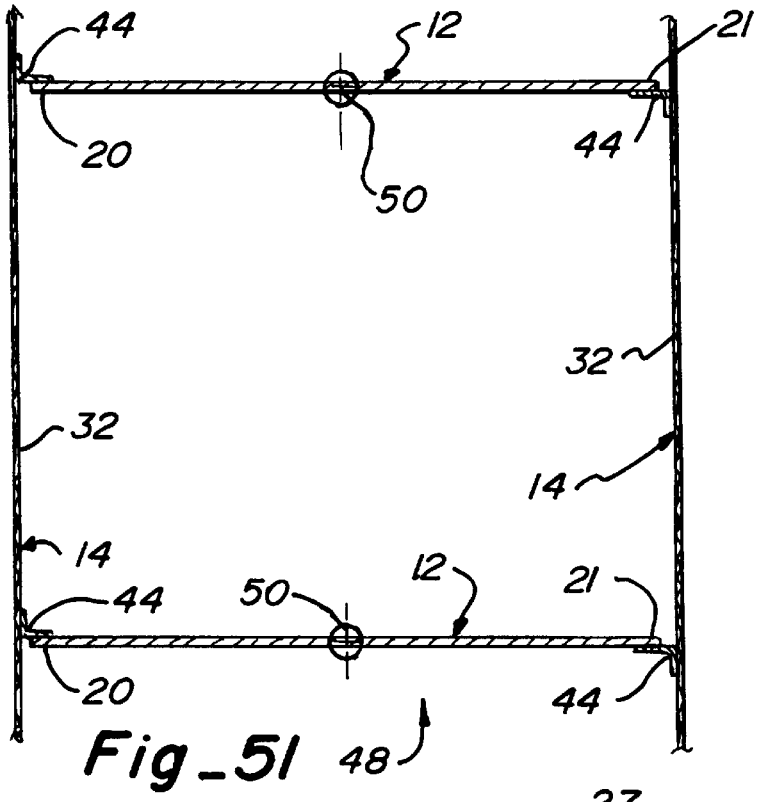
FIG. 51 is a fragmentary horizontal section taken through a sixth embodiment of the present invention wherein a pair of fabric sheets are connected to opposite side edges of the vanes in accordance with the connection system illustrated in FIGS. 36–43.
Figure 52:
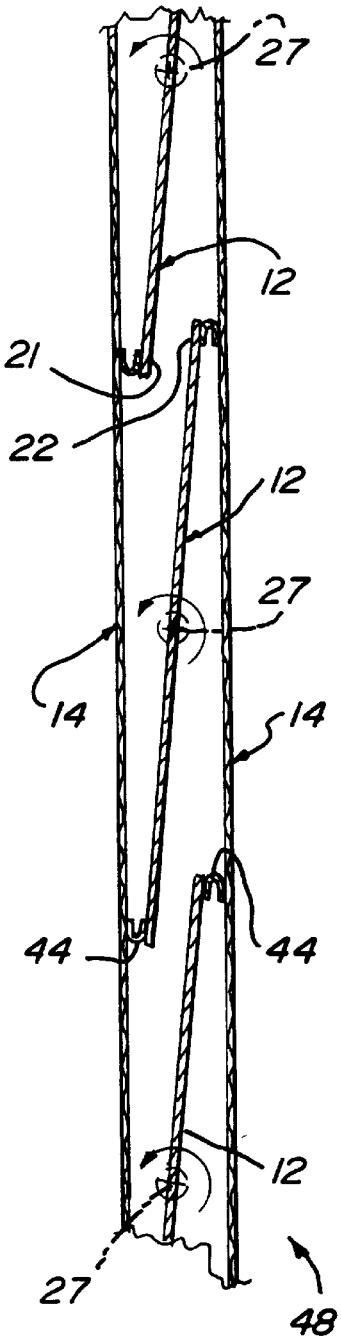
FIG. 52 is a fragmentary horizontal section similar to FIG. 51 with the vanes in a first closed position.
Figure 53:
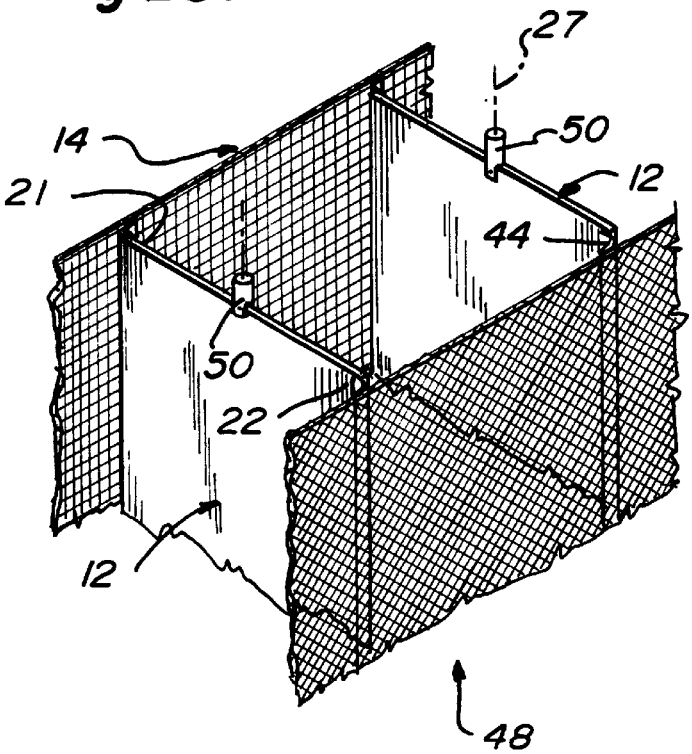
FIG. 53 is a fragmentary isometric view of the sixth embodiment as illustrated in FIG. 51.

With this embodiment and in fact with any embodiment of the invention disclosed herein subject to one caveat, the fabric sheet 14, depending upon its width, can be made to extend in any desired formation in front of a window opening. The sheet can assume a flat orientation if it is of minimal width, approximating the width of the window opening as shown in FIGS. 51–53, or can assume bows or curves when increasing the width of the fabric sheet relative to the width of the window opening as shown in all other FIGS. It should be pointed out that when the fabric sheet is directly connected to the vanes, as opposed to being connected with the flexible ribbon, some curves will be formed in the fabric sheet when the vanes are open and this needs to be accounted for when determining the size of the fabric desired for a particular window opening.

Figure 37:
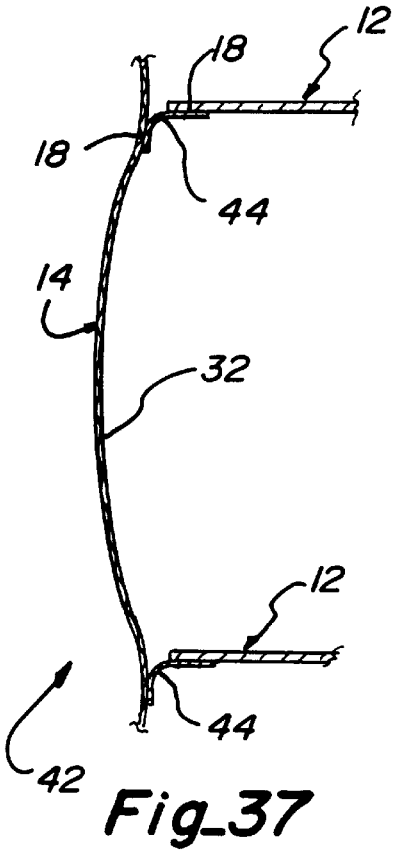
FIG. 37 is a fragmentary horizontal section showing the fabric sheet connected to a pair of vanes in accordance with the fourth embodiment of FIG. 36.
Figure 38:
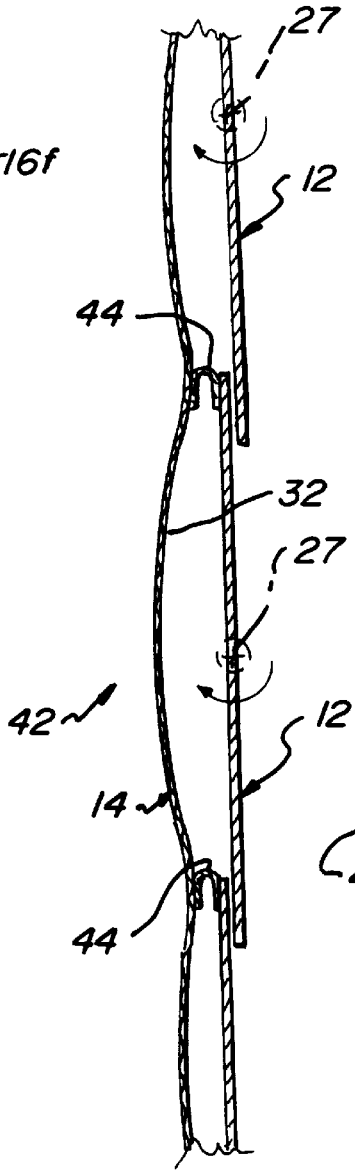
FIG. 38 is a fragmentary horizontal section similar to FIG. 37 with the vanes in a first closed position.
Figure 39:
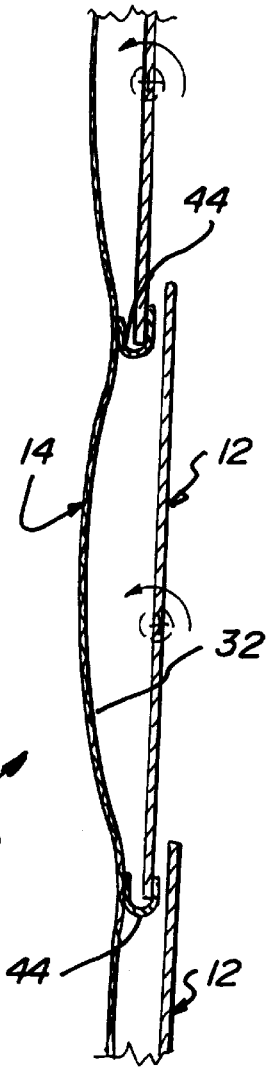
FIG. 39 is a fragmentary horizontal section similar to FIG. 38 with the vanes in a reverse second closed position.

In the fourth embodiment 42, when the vanes 12 are in the open position of FIG. 37 wherein they are substantially perpendicular to the fabric sheet 14, the connectors 44 take on a generally L-shaped configuration in horizontal cross section, but when the vanes 12 are moved into either the first closed position of FIG. 38 or the second closed position of FIG. 39, the ribbon-like connectors in horizontal cross section assume a generally inverted U-shaped or U-shaped configuration respectively. In any position of the vanes, however, the fabric sheet itself will again desirably assume continuous curves in a fashion similar to curtain-type window coverings.

Figure 40:
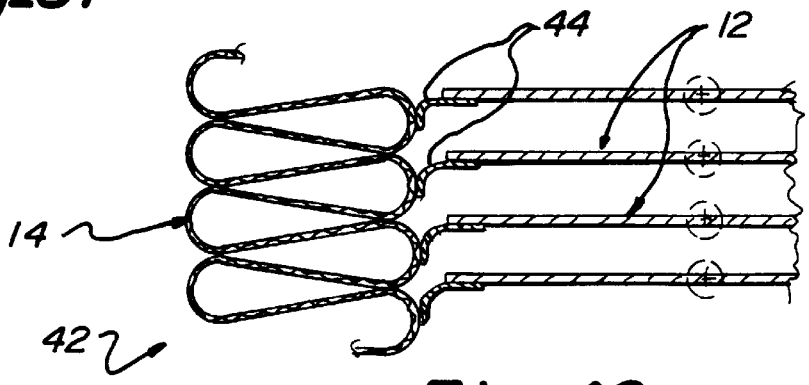
FIG. 40 is a fragmentary horizontal section similar to FIG. 37 with the vanes in an open position having been moved into closely adjacent relationship.

When the vanes 12 are in an open position but moved into closely spaced side-by-side relationship as illustrated in FIG. 40, it will be appreciated that the fabric sheet 14 assumes a plurality of adjacent S-shaped curves with each S-shaped curve being associated with a vane and wherein the fabric sheet is totally removed from, i.e. not confined to any degree between adjacent vanes.

Figure 41:
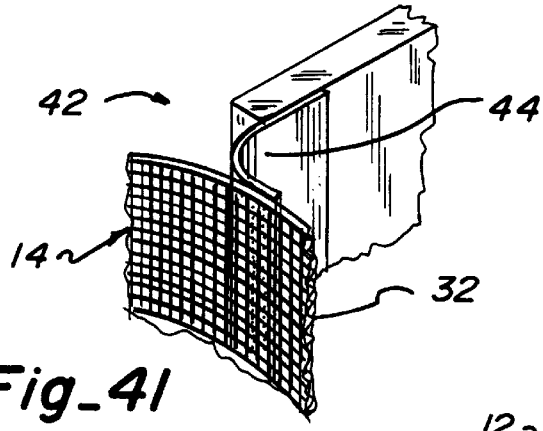
FIG. 41 is an enlarged fragmentary isometric view of FIG. 36 showing the attachment of the fabric sheet to a vane in accordance with the fourth embodiment of the invention.
Figure 42:
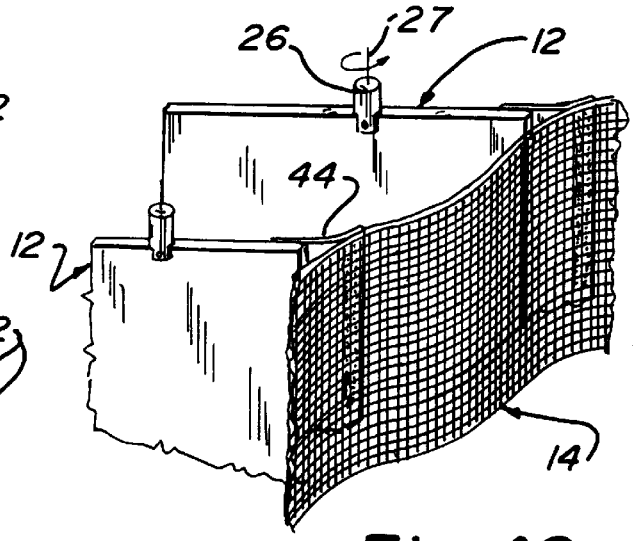
FIG. 42 is a fragmentary isometric view of the fabric sheet connected to a pair of open vanes in accordance with the fourth embodiment shown in FIG. 41.
Figure 43:
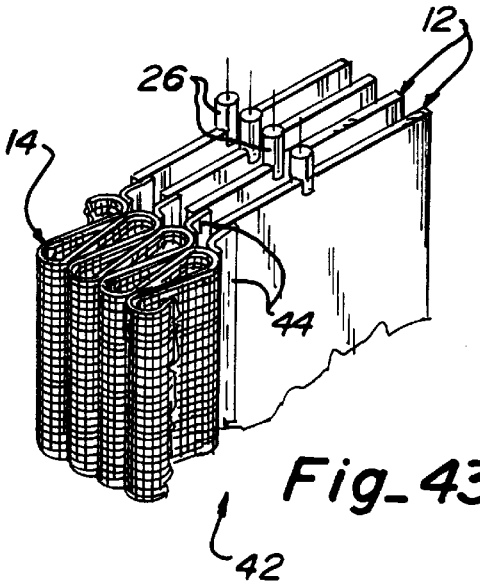
FIG. 43 is a fragmentary isometric view of the fourth embodiment as illustrated in FIG. 40.
Figure 44:
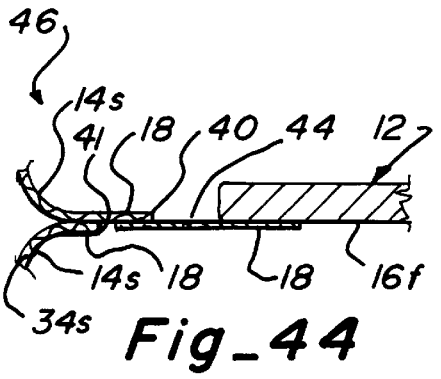
FIG. 44 is an enlarged fragmentary horizontal section showing the fabric sheet in a plurality of strips being connected to a rigid vane in accordance with a fifth embodiment of the present invention.

The fourth embodiment of the invention is shown in isometric views in FIGS. 41–43 wherein the aesthetics achieved by attaching the fabric sheet to the vanes with the connectors 44 are best appreciated. One of the advantages in utilizing a connector 44 as in the fourth embodiment is that the material from which the connector is made, which does most of the flexing during the operation of the window covering, can be chosen from materials having long wear characteristic so as to enhance the endurance of the window covering. Possibly a more important advantage is that there is less movement in the fabric sheet when the vanes are moved between open and closed positions than there is when the fabric sheet is connected directly to the vanes.

A fifth embodiment 46 of the window covering of the present invention is best illustrated in FIGS. 44–50 wherein again the fabric sheet 14 is made from a plurality of vertical strips 14*s* of fabric material which have been integrated into the one overall sheet 14 and wherein the fabric strips are affixed to the vanes 12 with separate elongated ribbon-type flexible connectors 44. The connection system utilized in the fifth embodiment is clearly shown in FIGS. 44 and 45 wherein each ribbon-like flexible connector 44 extends vertically of the window covering and is continuously bonded along a common face of the connector to a marginal area 18 on the front face 16*f* of a vane 12 and to a marginal area 18 on the outer face 34*s* of a strip 14*s* of the fabric sheet material along one side edge 40 of the strip. A marginal area 18 on the outer face 34*s* of the fabric strip 14*s* adjacent to the opposite side edge 41 of each fabric strip is bonded to the next adjacent fabric strip immediately adjacent to that strip's connection to the flexible ribbon-like connector 44. As will be appreciated, the fabric strips are bonded together with their outer faces 34*s* in confronting relationship. It will also be appreciated that the fifth embodiment 46 is very similar to the third embodiment 38 as far as the connection of the fabric strips are concerned and further incorporates a ribbon-type flexible connector of the type used in the fourth embodiment 42.

Figure 45:
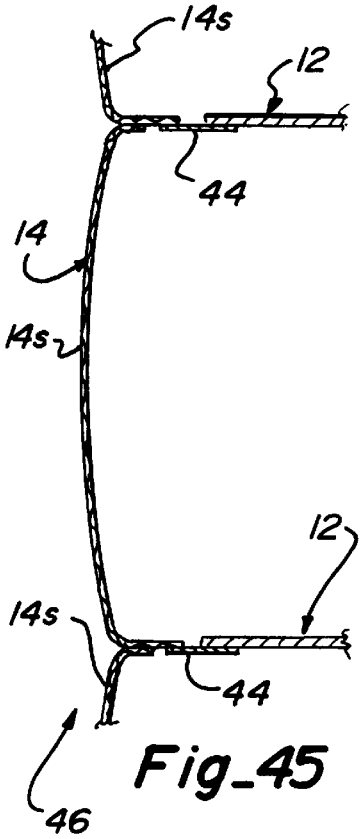
FIG. 45 is a horizontal section showing the fabric sheet connected to a pair of open vanes in accordance with the fifth embodiment of the present invention.
Figure 46:
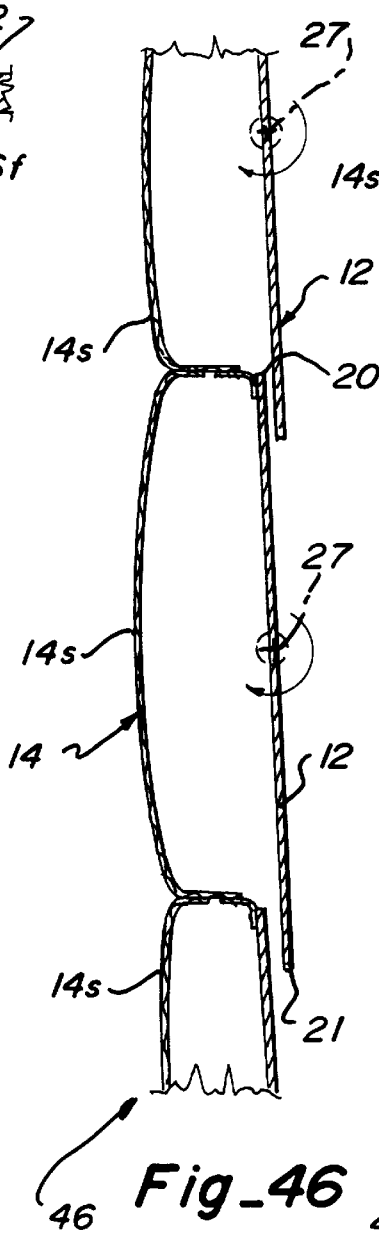
FIG. 46 is a fragmentary horizontal section similar to FIG. 45 with the vanes in a first closed position.
Figure 47:
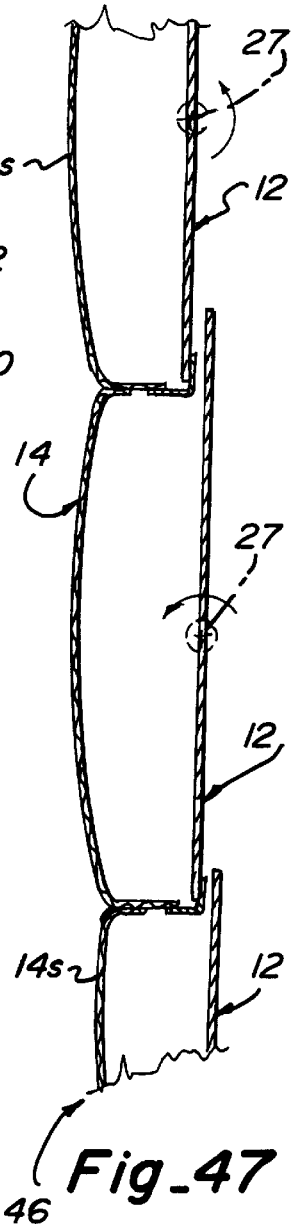
FIG. 47 is a fragmentary horizontal section similar to FIG. 46 with the vanes in a reverse second closed position.

With reference to FIGS. 45–47, when the vanes are in an open position, the flexible connectors 44 assume a generally planar or flat configuration with the fabric strips 14*s* bowing outwardly slightly in horizontally adjacent relationship. Similarly, when the vanes are moved to the first closed position of FIG. 46, the fabric strips still assume a similar position to that shown in FIG. 45 but the flexible connectors 44 have been flexed approximately 90 degrees into an L-shaped configuration to accommodate the movement of the vanes. When the vanes are pivoted approximately 180 degrees in a reverse direction into the second closed position shown in FIG. 47, again the flexible connectors assume a generally L-shaped configuration in horizontal cross section with the fabric sheets still appearing substantially the same as when the vanes are in an open position.

Figure 48:
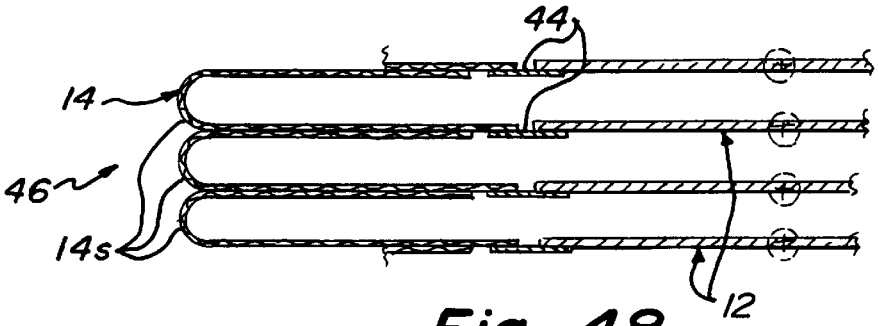
FIG. 48 is a fragmentary horizontal section similar to FIG. 45 with the vanes being positioned in closely adjacent relationship.

FIG. 48 shows the configuration of the fabric strips 14*s* when the vanes 12 are in an open position but moved into closely adjacent relationship and it will there be seen that each fabric strip assumes a generally U-shaped configuration in horizontal cross section while not being confined between adjacent vanes and wherein the flexible ribbon-like connector 44 assumes a planar configuration.

Figure 49:
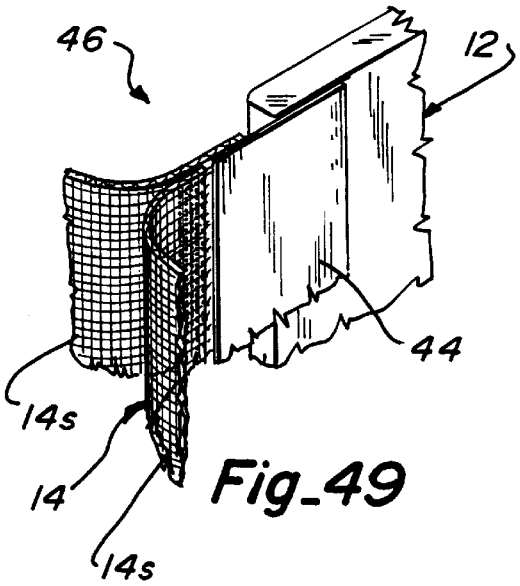
FIG. 49 is an enlarged fragmentary isometric view of the fifth embodiment as shown in FIG. 44.
Figure 50:
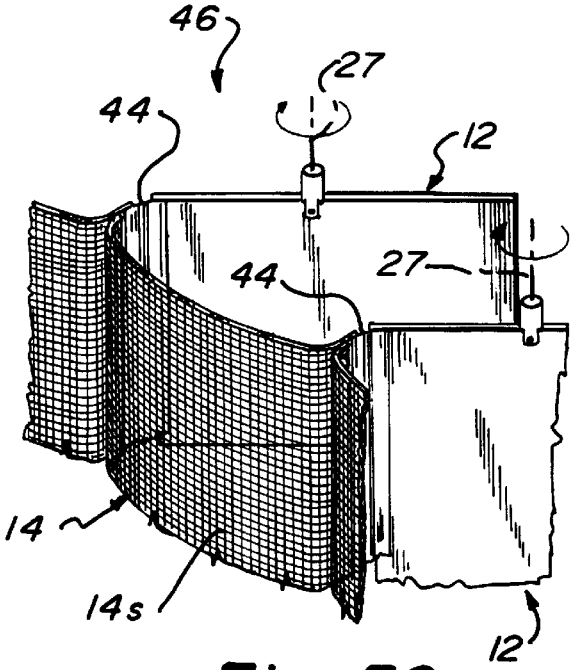
FIG. 50 is a fragmentary isometric view of the fifth embodiment of the invention showing the vanes in a position intermediate a fully opened and fully closed position.

The fifth embodiment 46 of the invention is shown isometrically in FIGS. 49 and 50 wherein the aesthetics of this embodiment of the invention are better appreciated.

A sixth embodiment 48 of the window coveting of the present invention is shown in FIGS. 51–53 and it will be appreciated that this embodiment is very similar to the fourth embodiment 42 in that the same system for connecting a fabric sheet 14 to a vane 12 is employed. However, in this embodiment, a pair of fabric sheets 14 are affixed to the vanes adjacent to opposite side edges 20 and 21 of the vanes. In other words, each fabric sheet 14 is connected to a marginal area 18 on the planar face 16 of the vane adjacent to an associated side edge of the vane. Each ribbon-type connector 44 is continuously bonded to the innermost face 32 of the adjacent fabric sheet 14 with which it is associated and to one face 16 of a vane. It should be appreciated that the ribbon-type connectors associated with one fabric sheet are affixed to the opposite planar face 16 of a vane from the ribbon connectors associated with the other fabric sheet. As mentioned previously, the ribbon-type connectors can be made of any desired material and could be fabric, plastic or the like as long as they have a high degree of flexibility in the transverse direction. The window covering 48 assumes the position shown in FIG. 51 when the vanes are in an open position and in FIG. 52 when the vanes are in a first closed position. FIG. 53 illustrates the sixth embodiment isometrically.

It will be appreciated in understanding the sixth embodiment 48 of the invention that the vanes 12 would not necessarily have to be suspended vertically even though they are illustrated in such an orientation in FIGS. 51 through 53. In other words, each vane is shown having a central vertically extending shaft 50 adapted to be connected to a typical carrier 24 (FIGS. 2 and 3) used in vertical vane window coverings, but the vanes do not need to have the shaft 50 and in fact could be disposed horizontally and pivoted about their then horizontal longitudinal axes. In order to pivot the vanes about longitudinal horizontal axes, each sheet of fabric material could be linearly shifted in opposite vertical directions. A system for moving a window covering of this general type between open and closed positions is disclosed broadly in co-pending application Ser. No. 07/963,318 filed Nov. 18, 1992, which is of common ownership with the present application and is herein incorporated by reference. Such a system with possibly slight modification could be used to operate this embodiment of the window covering of the present invention.

It should also be pointed out that each embodiment of the present invention as illustrated previously in connecting a fabric to a marginal area 18 of a plurality of vanes 12 could be duplicated so that two sheets of fabric 14 are connected to marginal areas adjacent to opposite side edges 20 and 21 of a plurality of vanes in a manner similar to the sixth embodiment. In other words, each system for connecting one fabric sheet to a plurality of vanes could be employed for connecting two fabric sheets to a plurality of vanes thereby creating a window covering that could have the vanes oriented vertically or horizontally.

Figure 55:
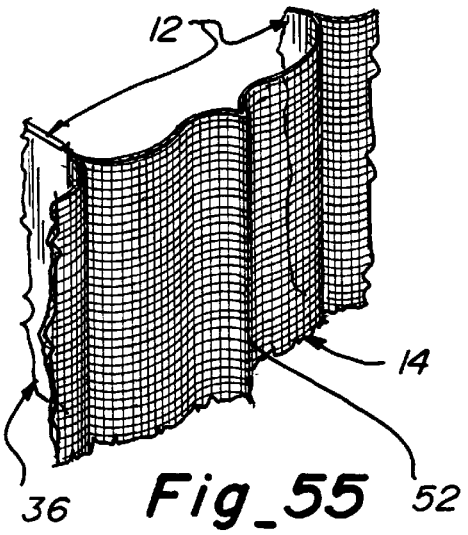
FIG. 55 is a fragmentary isometric view similar to FIG. 22 with the fabric sheet having been pleated at an intermediate location between adjacent vanes.

Other variations of window coverings utilizing the concepts previously described for connecting fabric sheets to rigid vanes are illustrated in FIGS. 55–61. For example, FIG. 55 shows a fabric sheet 14 connected to rigid vanes 12 in accordance with the second embodiment 36 of the invention but wherein the fabric sheet has an externally directed creased-type pleat 52 at a location intermediate each vane. As can be appreciated, this arrangement has the advantages of the second embodiment while creating a different aesthetic appearance.

Figure 54:
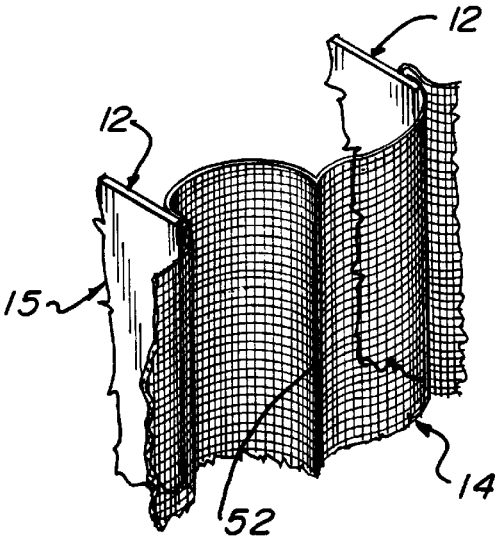
FIG. 54 is a fragmentary isometric view similar to FIG. 10 with the fabric sheet having been pleated at an intermediate location between adjacent vanes.

Similarly, FIG. 54 shows a fabric sheet 14 connected to rigid vanes 12 in accordance with the first embodiment 15 of the present invention but again wherein the fabric sheet 14 has a vertically oriented outwardly directed creased-type pleat 52 formed between each vane. Again, this arrangement derives the advantages of the first embodiment for connecting a fabric sheet to rigid vanes while creating a different aesthetic appearance.

Figure 56:
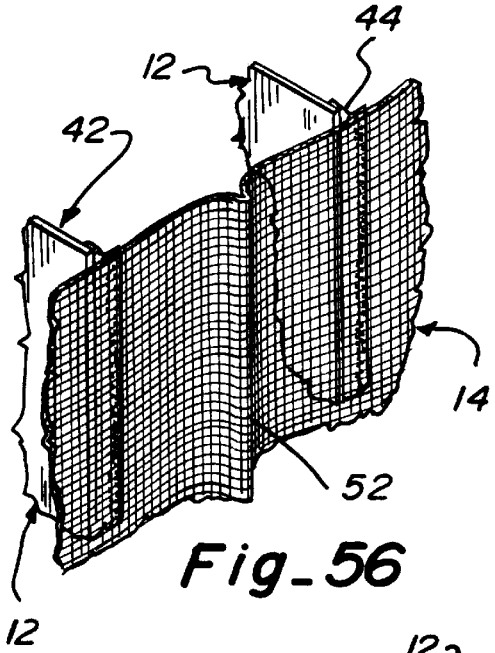
FIG. 56 is a fragmentary isometric view similar to FIG. 42 with the fabric sheet having been pleated at an intermediate location between adjacent vanes.

FIG. 56 shows still another arrangement wherein the fourth embodiment 42 for connecting the fabric sheet 14 to rigid vanes 12 is employed such that the fabric sheet is connected to the vanes with flexible ribbon-type connectors 44 but wherein the flexible sheet has vertically extending outwardly directed creased-type pleats 52 intermediate adjacent vanes.

Figure 57:
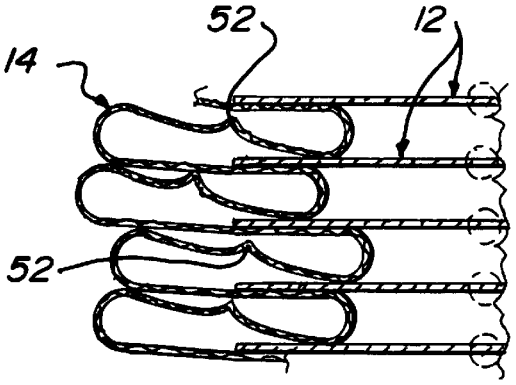
FIG. 57 is a fragmentary horizontal section showing the window covering of FIG. 54 with the vanes in an open position but moved into closely adjacent relationship with each other.
Figure 59:
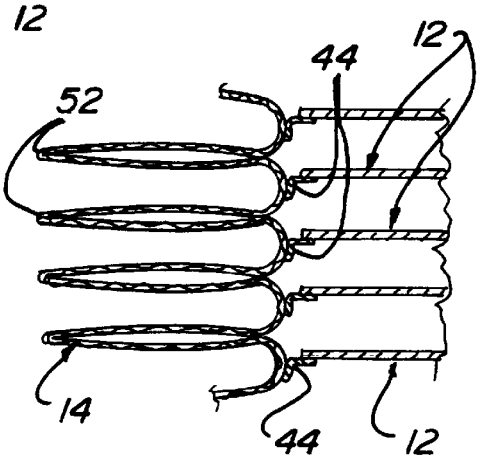
FIG. 59 is a fragmentary horizontal section showing the embodiment of FIG. 56 with the vanes in an open position but having been moved into closely adjacent relationship.
Figure 58:
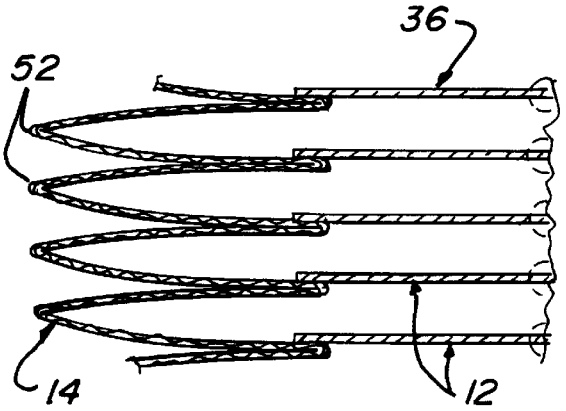
FIG. 58 is a fragmentary horizontal section showing the embodiment of FIG. 55 with the vanes in an open position but moved closely adjacent to each other.
Figure 60:
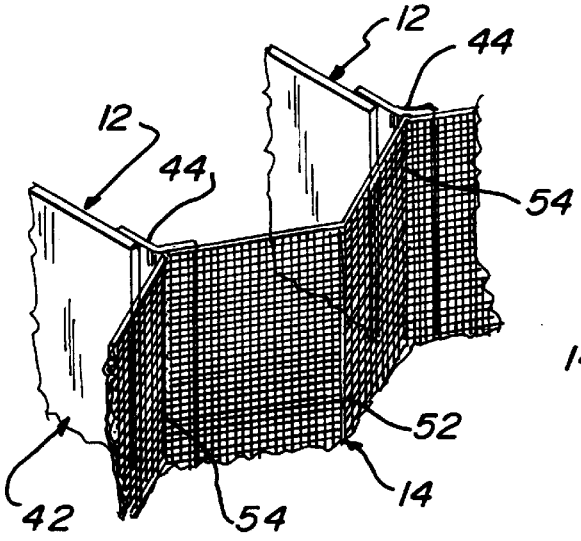
FIG. 60 is a fragmentary isometric view of another embodiment of the invention similar to FIG. 42 but wherein the fabric sheet has been pleated in opposite directions at each vane and at an intermediate location between adjacent vanes.

Each of the arrangements shown in FIGS. 54–56 are illustrated in horizontal cross section in FIGS. 57–58, respectively, wherein the relationship of the fabric material to the vanes is illustrated with the vanes in an open but closely adjacent relationship.

Figure 61:
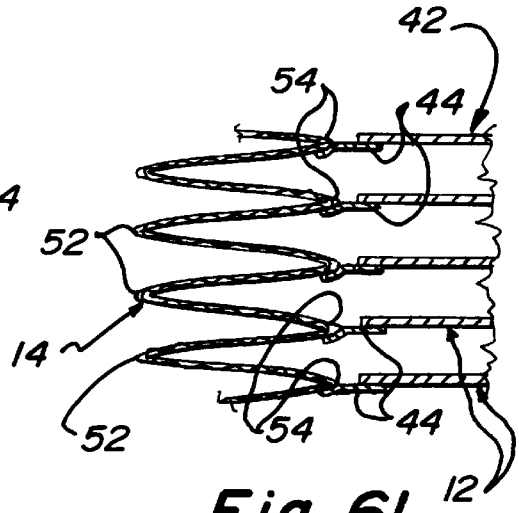
FIG. 61 is a horizontal section showing the embodiment of FIG. 60 with the vanes in an open position but having been moved into closely adjacent relationship.

FIG. 61 shows still a different arrangement wherein a fabric sheet 14 is connected to rigid vanes 12 in accordance with the teachings of the fourth embodiment 42 through use of flexible ribbons 44, but in this arrangement, the fabric sheet has inwardly directed vertical creased-type pleats 54 being aligned with each vane and outwardly directed vertical creased-type pleats 52 being positioned intermediate each vane. FIG. 61 illustrates the relationship of the fabric sheet to the vanes shown in FIG. 60 when the vanes are in an open position but closely spaced relative to each other.

Figure 62:
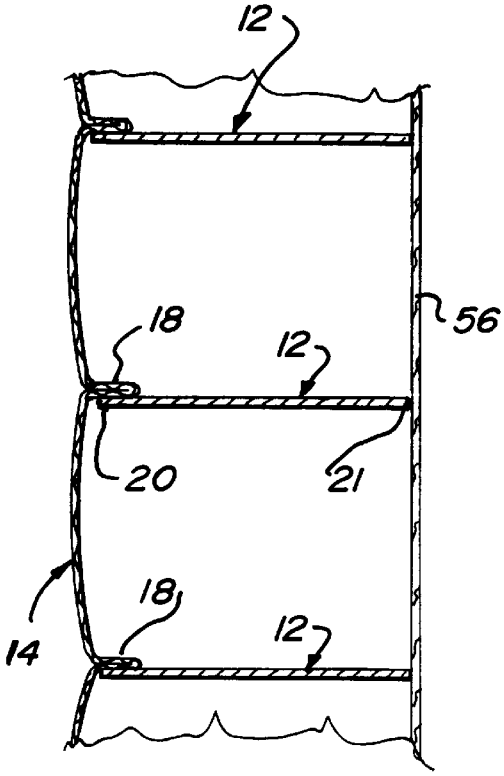
FIG. 62 is a side view of another embodiment of the invention showing a single fabric sheet affixed to the vanes similarly to that shown in FIG. 17 and with vertical support cords affixed to an opposite edge of the vanes.
Figure 63:
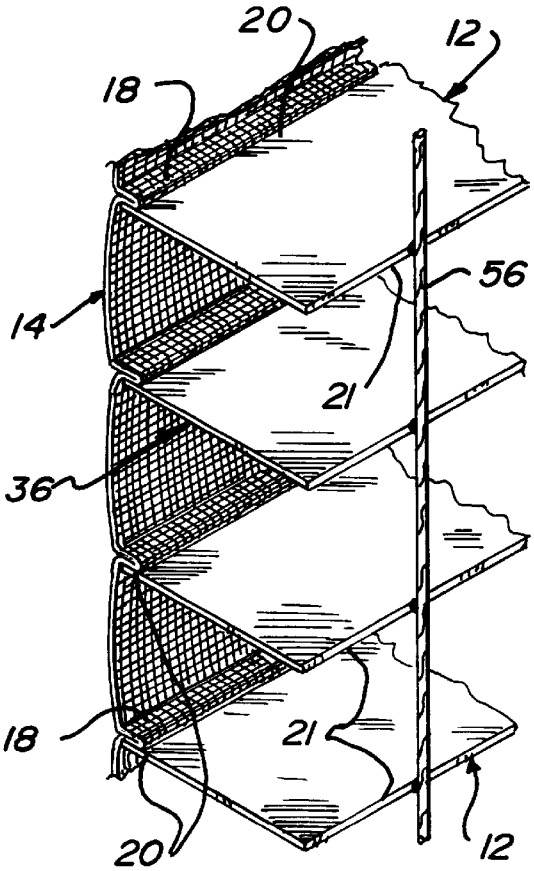
FIG. 63 is an isometric view of FIG. 62.

FIGS. 62 and 63 show still another variation of the present invention wherein vanes 12 that are deployed horizontally have a fabric sheet 14 secured to marginal areas 18 of the vanes adjacent to one side edge 20 in accordance with the teachings of the second embodiment 36. In this arrangement, a plurality of spaced vertical cords 56 are fixed to each vane adjacent to the opposite side edge 21 so that the cords in cooperation with the fabric sheet can be linearly shifted in opposite vertical directions in a known manner to pivot the vanes between open and closed positions. Examples of the use of cords on window coverings of the type having pivotal vanes are shown more fully in U.S. Pat. No. 4,928,369 and Australian Patent No. 249,985 which are herein incorporated by reference.

It will be appreciated that the use of cords 56 as shown in FIGS. 62 and 63 in a horizontal vane type window covering could be utilized with any of the aforedescribed embodiments for connecting fabric sheets 14 to rigid vanes 12 depending upon the features of a window covering desired for a particular window opening. Its use is preferable, however, in embodiments where the fabric sheets are substantially flat.

It will be appreciated from the description of the various embodiments of the present invention that several unique systems for attaching flexible fabric material to rigid vanes have been described. The systems are each felt to provide aesthetically pleasing window coverings having long durability and with some versatility due to the ability to employ the teachings with single or double sheets of fabric material and with vertical or horizontally disposed vanes. While the fabric material can vary in structure, it typically is made of a transparent or translucent fabric and the vanes are typically made of an opaque material so that when the window covering is in a closed position, it effectively blocks light and vision.

In accordance with the teaching in co-pending application Ser. No. 07/701,165 filed May 17, 1991, U.S. Pat. No. 5,313,999 which is of common ownership with the present invention, when dual sheets of see-through fabric having a matrix of openings therethrough are utilized, it is desirable that the sheets of fabric have differing hole patterns or hole sizes to avoid the moire effect which has been detrimental in many prior art systems to an aesthetically pleasing window covering product.

Although the present invention has been described with a certain degree of particularity, it is understood that the present disclosure has been made by way of example, and changes in detail or structure may be made without departing from the spirit of the invention, as defined in the appended claims.

We claim:

1. A light control window covering comprising in combination, a sheet of fabric material having an inner face and an outer face, a plurality of substantially planar rigid elongated vanes having a longitudinal axis and being positioned adjacent to the inner face of said sheet, said vanes having planar faces and side edges with said sheet being positioned adjacent to one side edge, each planar face having marginal areas adjacent to said side edges, a plurality of elongated flexible cords positioned along the opposite side edge of said vanes from said sheet and extending perpendicularly to said vanes, said cords being affixed to each of said vanes along said opposite side edge and said inner face of said sheet being affixed along straight lines to the marginal area of a planar face of each of said vanes adjacent said one side edge of said vanes, and means for pivoting said vanes about their longitudinal axes between a closed position wherein the vanes lie in substantially parallel relationship with said sheet and an open position wherein the vanes lie in substantially perpendicular relationship to said sheet, and wherein when said vanes are in the open position, the sheet in cross-section perpendicular to said vanes forms an S-shaped curve associated with each vane.

2. The window covering of claim 1 wherein said S-shaped curves are at least partially confined between adjacent vanes.

3. A light control window covering comprising in combination, a sheet of fabric material having an inner face and an outer face, a plurality of substantially planar rigid elongated vanes having a longitudinal axis and being positioned adjacent to the inner face of said sheet, said vanes having planar faces and side edges with said sheet being positioned adjacent to one side edge, each planar face having marginal areas adjacent to said side edges, a plurality of elongated flexible cords positioned along the opposite side edge of said vanes from said sheet and extending perpendicularly to said vanes, said cords being affixed to each of said vanes along said opposite side edge and said inner face of said sheet being affixed along straight lines to the marginal area of a planar face of each of said vanes adjacent said one side edge of said vanes with said sheet being folded back upon and bonded to itself along its connection to said marginal area of the planar face of each vane, and means for pivoting said vanes about their longitudinal axis between a closed position wherein the vanes lie in substantially parallel relationship with said sheet and an open position wherein the vanes lie in substantially perpendicular relationship to said sheet.

4. The window covering of claim 3 wherein when said vanes are in the open position, the sheets in cross section perpendicular to said vanes form a U-shaped curve associated with each vane.

5. The window covering of claim 4 wherein said fabric sheet is creased to point outwardly away from said vanes at intermediate locations between said vanes.

6. A light control window covering comprising in combination, a sheet of fabric material having an inner face and an outer face, a plurality of substantially planar rigid elongated vanes having a longitudinal axis and being positioned adjacent to the inner face of said sheet, said vanes having planar faces and side edges with said sheet being positioned adjacent to one side edge, each planar face having marginal areas adjacent to said side edges, a plurality of elongated flexible cords positioned along the opposite side edge of said vanes from said sheet and extending perpendicularly to said vanes, said cords being affixed to each of said vanes along said opposite side edge and said inner face of said sheet being affixed along straight lines to said marginal area of a planar face of each of said vanes adjacent said one side edge of said vanes, and means for pivoting said vanes about their longitudinal axis between a closed position wherein the vanes lie in substantially parallel relationship with said sheet and an open position wherein the vanes lie in substantially perpendicular relationship to said sheet, and wherein said sheet is affixed to said vanes along said marginal areas with flexible connectors, said connectors being bonded to the inner face of said sheet and to a marginal area of a planar face of said vanes such that when said vanes are in the closed position, the connectors in cross-section perpendicular to said vanes are-of U-shaped configuration.

7. The window covering of claim 6 wherein said fabric sheet is creased to point outwardly away from said vanes at intermediate locations between said vanes.

8. A light control window covering comprising in combination, a sheet of fabric material having an inner face and an outer face, a plurality of substantially planar rigid elongated vanes having a longitudinal axis and being positioned adjacent to the inner face of said sheet, said vanes having planar faces and side edges with said sheet being positioned adjacent to one side edge, each planar face having marginal areas adjacent to said side edges, a plurality of elongated flexible cords positioned along the opposite side edge of said vanes from said sheet and extending perpendicularly to said vanes, said cords being affixed to each of said vanes along said opposite side edge and said inner face of said sheet being fixed along straight lines to the marginal area of a planar face of each of said vanes adjacent said one side edge of said vanes, said sheet being composed of a plurality of elongated contiguous strips of fabric extending longitudinally in a direction parallel to the longitudinal direction of said vanes and having inner and outer faces and side edges, said strips in each sheet being bonded together adjacent to said straight lines, each strip having a longitudinal marginal area on each face adjacent to said side edges, one marginal area of each strip being affixed to one marginal area of a vane and another marginal area of each strip adjacent to the opposite side edge of said strip from said one marginal area of said strip being bonded to an adjacent strip, and means for pivoting said vanes about their longitudinal axis between a closed position wherein the vanes lie in a substantially parallel relationship with said sheet and an open position wherein the vanes lie in a substantially perpendicular relationship to said sheet.

9. The window covering of claim 8 wherein said vanes in said closed positions have a face which confronts said sheet and a face which is non-confronting to said sheet and wherein said marginal area of each strip is affixed to the non-confronting face of an associated vane when the vanes are in the closed position.

10. The window covering of claim 9 wherein said another marginal area of each strip is bonded to the adjacent strip in an outer face to outer face relationship.

11. The window covering of claim 8 wherein said marginal area of each strip is affixed to said one marginal area of a vane with a flexible connector.

12. The window covering of claim 11 wherein said vanes in the closed position have a face which confronts said sheet and a face which is non-confronting to said sheet and wherein each of said flexible connectors comprises an elongated ribbon of material bonded to the outer faces of said strips and to the confronting face of an associated vane.

13. The window covering of claim 12 wherein each of said flexible connectors has two faces and is bonded to said strips of fabric and said associated vanes on the same face of said connector.

14. The window covering of claim 12 wherein said sheet in cross section perpendicular to said vane forms a U-shaped curve associated with each vane when the vanes are in the open position.

15. The window covering of claim 14 wherein said sheet in cross section perpendicular to said vanes forms a U-shaped curve associated with each vane when the vanes are in the open and closed positions.

* * * * *